US012550954B2

(12) United States Patent
Chin

(10) Patent No.: US 12,550,954 B2
(45) Date of Patent: Feb. 17, 2026

(54) ACCESSORY RESTRAINT SYSTEMS AND METHODS OF MANUFACTURE

(71) Applicant: Mark R Chin, Rancho Cucamonga, CA (US)

(72) Inventor: Mark R Chin, Rancho Cucamonga, CA (US)

(73) Assignee: A Project LLC, Rancho Cucamonga, CA (US)

( * ) Notice: Subject to any disclaimer, the term of this patent is extended or adjusted under 35 U.S.C. 154(b) by 56 days.

(21) Appl. No.: 18/493,716

(22) Filed: Oct. 24, 2023

(65) Prior Publication Data

US 2024/0130446 A1 Apr. 25, 2024
US 2024/0225144 A9 Jul. 11, 2024

Related U.S. Application Data

(60) Provisional application No. 63/380,839, filed on Oct. 25, 2022.

(51) Int. Cl.
*A41D 13/00* (2006.01)
*A41D 1/06* (2006.01)

(52) U.S. Cl.
CPC ..... *A41D 13/0012* (2013.01); *A41D 1/06* (2013.01); *A41D 2400/48* (2013.01)

(58) Field of Classification Search
CPC ... A41D 13/0012; A41D 1/06; A41D 2400/48
See application file for complete search history.

(56) References Cited

U.S. PATENT DOCUMENTS 3,664,560 A * 5/1972 Perkins ..... F42B 39/02 224/663
4,165,826 A * 8/1979 Chica ..... F41C 33/048 224/191
4,294,385 A * 10/1981 Rogers ..... F41C 33/0236 224/665
4,632,389 A * 12/1986 Moss ..... A42B 1/24 273/DIG. 30

(Continued)

FOREIGN PATENT DOCUMENTS

EP 1371304 A1 * 12/2003 ..... A41D 1/085

*Primary Examiner* — Khaled Annis
(74) *Attorney, Agent, or Firm* — Eversheds Sutherland (US) LLP

(57) ABSTRACT

Accessory restraint systems, accessories, and methods of manufacture are provided. An accessory restraint system may be securable to a garment and may include one or more fastening portions designed to be secured to an interior portion of the garment by stitching or another process. One or more accessories may be removably attachable to the fastening portion(s). Each fastening portion may include a hook-and-loop material and may be designed as a single length of the hook-and-loop material or as a number of patches including the hook-and-loop material. The hook-and-loop material may have any dimensions or characteristics compatible with any number of garments. The garment may be a bottom garment (e.g., a pair of jeans or yoga pants) or any other garment. The interior portion of the garment may be a waistband or a pocket. Compatible accessories may include a pouch, a sheath, a holster, a belt, or any other accessory.

16 Claims, 14 Drawing Sheets

(56) References Cited

U.S. PATENT DOCUMENTS 4,819,846 A * 4/1989 Hannemann ..... A45F 5/00 224/241
4,957,231 A * 9/1990 Kalisher ..... A01K 97/06 224/268
5,060,314 A * 10/1991 Lewis ..... A62B 17/003 2/2.5
5,240,156 A * 8/1993 Sicotte ..... A45F 5/02 224/583
5,464,136 A * 11/1995 Eddy ..... F41C 33/046 2/322
D482,863 S * 12/2003 Flood ..... D3/224
6,913,176 B1 * 7/2005 Buscemi ..... A45F 5/00 224/665
8,056,781 B1 * 11/2011 Rowe ..... B62B 5/068 224/575
8,225,976 B2 * 7/2012 Meunier ..... A45F 5/02 224/675
9,339,102 B2 * 5/2016 Iosilevich ..... A45F 3/14
9,513,084 B1 * 12/2016 Baugh ..... F41C 33/0209
11,259,583 B1 * 3/2022 Spanopoulos ..... F41C 33/0236
11,576,451 B2 * 2/2023 Wexelbaum ..... A41F 9/025
2004/0083525 A1 * 5/2004 Wells, Jr. ..... F41H 1/02 2/2.5
2005/0066424 A1 * 3/2005 Salazar ..... A41D 13/0012 2/227
2007/0057003 A1 * 3/2007 Keyes ..... A45F 5/021 224/663
2007/0246298 A1 * 10/2007 Botti ..... F16B 45/005 182/3
2008/0230313 A1 * 9/2008 Botti ..... A62B 1/16 182/129
2013/0018350 A1 * 1/2013 McNulty ..... A61F 13/622 604/385.03
2015/0359273 A1 * 12/2015 Olson ..... A41D 13/0012 2/250
2016/0091279 A1 * 3/2016 Massaro, Jr. ..... F41C 33/04 224/581
2019/0223582 A1 * 7/2019 DiPierro ..... A41D 1/06
2022/0071328 A1 * 3/2022 Wexelbaum ..... A45F 5/021
2022/0187044 A1 * 6/2022 Calvo ..... F41C 33/0227
2022/0287401 A1 * 9/2022 Wexelbaum ..... A45F 5/021
2024/0130446 A1 * 4/2024 Chin ..... A41D 13/0012
2024/0191969 A1 * 6/2024 Maskell ..... F41C 33/041

* cited by examiner

ACCESSORY RESTRAINT SYSTEMS AND METHODS OF MANUFACTURE

CROSS-REFERENCE TO RELATED APPLICATION

This application is related to, and claims the benefit of, U.S. Provisional Patent Application No. 63/380,839, the entire contents of which are incorporated herein by reference.

TECHNICAL FIELD

The present disclosure relates, in general, to accessory restraint systems, and, more particularly, to accessory restraint systems securable to garments and associated methods of manufacturing accessory restraint systems.

BACKGROUND

Existing accessories, including firearm holsters, storage pouches, knife sheaths, phone cases, and the like, generally attach to garments such as apparel bottoms using plastic or metal hooks, plastic or metal clips, straps, or belts in order to achieve retention of the given accessory with respect to the chosen garment. However, attaching accessories to garments in this manner presents a number of undesirable functional limitations.

For one, the accessories described above may only be usable with a limited number of garments because particular means of attachment (e.g., hooks, clips, straps, or belts) are required and may not be compatible with a preferred garment. As such, a user is often required to choose between either using a particular accessory or wearing a preferred garment, but not both, at a given time. Moreover, in many cases, certain accessories may only be attachable to a given garment about an outer circumference of the garment. This may further hinder a user, as attached accessories will be more likely to catch or snag against foreign objects while the user is traveling about an environment in the garment. In addition, the user will not be able to conceal the outwardly-visible accessories from the view of third parties who may also be present in the environment. Further still, even where an accessory can be attached to an inner circumference of a particular garment, an outline of the accessory may be "printed" or displayed on an exterior portion of the garment, which may be similarly undesirable for a user who does not wish for third parties to know that the user is carrying the given accessory on their person.

Accordingly, there is a need for improved accessory restraint systems that are securable to a broad array of garments and provide for removable attachment of one or more accessories in a discreet and customizable manner. Similarly, there is a need for improved methods of manufacturing such accessory restraint systems. Further still, there is a need for improved accessories for use with such accessory restraint systems.

SUMMARY OF THE INVENTION

The present disclosure is directed to accessory restraint systems securable to garments, accessories for use with accessory restraint systems securable to garments, and methods of manufacturing accessory restraint systems securable to garments. For example, in accordance with one aspect of the present invention, an accessory restraint system may be securable to a garment and may include one or more fastening portions that are designed to be secured to an interior portion of the garment. One or more accessories may be removably attachable to the one or more fastening portions.

The fastening portion(s) may include a hook-and-loop material and may be designed as a single length of hook-and-loop material or as a number of patches including the hook-and-loop material. The fastening portion(s) may, alternatively or in addition, include a fastening material that is removably attachable to the hook-and-loop material. The hook-and-loop material may have any dimensions compatible with any number or types of garments. For example, the hook-and-loop material may have a height between approximately one and five inches, or any other height. The hook-and-loop material may further have any length. For example, where the hook-and-loop material is a component of the patches described above, the patches may each have a length between approximately two and eight inches, or any other length.

The hook-and-loop material may have a stretch characteristic, the garment may have another stretch characteristic, and the two stretch characteristics may be within a given stretch threshold of one another. The fastening portion(s) may be designed to be secured to the interior portion of the garment: by stitching in a pattern such as a box-stitch pattern, a zigzag-stitch pattern, or a bar tack or tacking pattern; at one or more attachment locations to prevent the one or more accessories from printing or displaying outlines on an exterior portion of the garment while any such accessories are attached to the fastening portion(s) at the attachment location(s); and/or in an orientation defining one or more spacings between the fastening portion(s) and one or more opening or separation locations of the garment (e.g., buttoning or zipper locations).

Accessories compatible with the accessory restraint system may include a pouch, a sheath, a holster, a utility belt, a magazine pouch, and/or any other accessory. Each accessory may include a main portion and/or one or more accessory-fastening portions. The accessory-fastening portion(s) may be securable to the main portion and may be designed to be removably attached to the fastening portion(s) of the accessory restraint system. The accessory-fastening portion(s) may each include the hook-and-loop material or a fastening material that is removably attachable to the hook-and-loop material. The accessory-fastening portion(s) may be permanently securable to the main portion by stitching, gluing, or bonding. Alternatively, or in addition, each accessory may include one or more mounted attachments. The mounted attachment(s) may include the accessory-fastening portion(s) and may be permanently or removably securable to the main portion by one or more fasteners. The mounted attachment(s) may be rotatable, with respect to the main portion, about the fastener(s).

The garment to which the accessory restraint system is securable may be a bottom garment (e.g., a pair of jeans, shorts, yoga pants, a dress, a skirt, or any other bottom garment) or any other garment. The interior portion of the garment may be a waistband or a pocket of the garment.

The accessory restraint system may be manufactured via a method that provides for any number of the aforementioned characteristics or features. The method of manufacturing the accessory restraint system may, alternatively or in addition, include applying a garment-washing technique to the garment. The fastening portion(s) may be secured to the interior portion of the garment by stitching in the pattern such as the box-stitch pattern, the zigzag-stitch pattern, or the bar tack or tacking pattern. The stitching may be performed manually, either by a folder attachment for a sewing machine or by a sewing machine with a sewing foot, based at least in part on the garment-washing technique applied to the garment.

Accordingly, the accessory restraint system, as well as the associated accessories and methods of manufacture, may offer numerous benefits over existing systems, devices, accessories, or methods.

DETAILED DESCRIPTION OF THE INVENTION

Figure 1A:
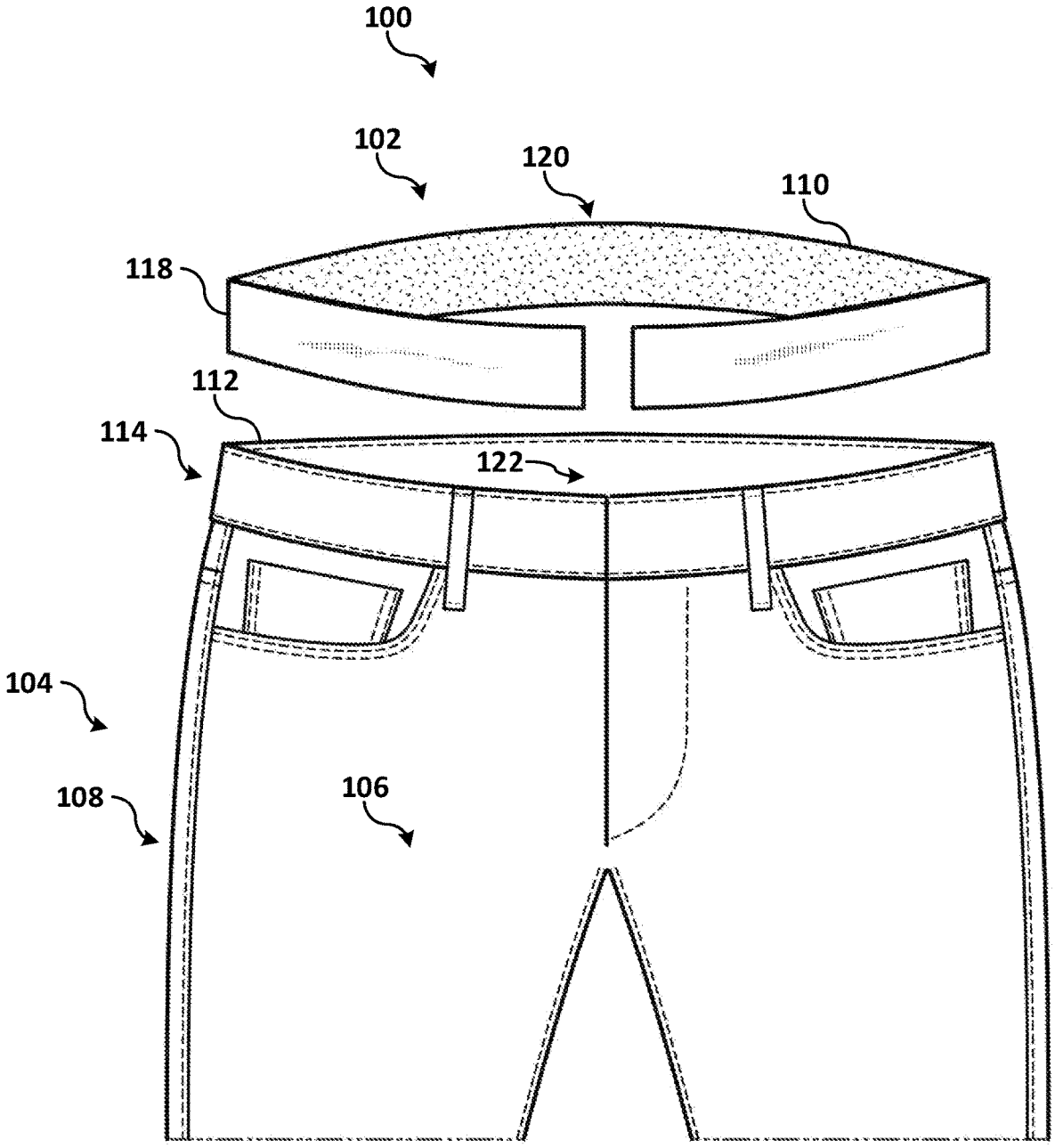
FIGS. 1A-1F are various exploded and perspective views of an accessory restraint system, associated with a garment, in accordance with one or more aspects of the present disclosure.

Accessory restraint systems securable to garments, associated accessories for use with accessory restraint systems, and associated methods of manufacturing accessory restraint systems have been developed. An accessory restraint system may be securable to a garment. The accessory restraint system may include one or more fastening portions, which may be designed to be secured to an interior portion of the garment. One or more accessories may be removably attachable to the one or more fastening portions.

The one or more fastening portions may include a hook-and-loop material or a fastening material removably attachable to the hook-and-loop material. It will be understood that the fastening portions (and various other components or features described or envisioned herein) may be composed entirely of the hook-and-loop material or the fastening material or may include one or more additional structural layers or components such as a backing material to which the hook-and-loop material or the fastening material may be attached. Moreover, it will be understood, in view of the numerous envisioned embodiments of the present invention, that any reference to hook-and-loop material provided throughout the present disclosure (including with respect to the fastening portions or any other component or feature described or envisioned herein) additionally contemplates various uses and combinations of hook material and/or loop material. As such, any component of the present invention described as including or being hook-and-loop material may, depending on a given embodiment, include or be hook material, loop material, or any combination thereof. Further still, it will be understood that a wide range of fastening materials other than hook-and-loop material may also be compatible with hook-and-loop material. For example, hook-and-loop material may be removably attachable to numerous garment materials that do not include hook-and-loop material, including but not limited to cotton, polyester, poly-blends, nylon, and many other fabrics and materials. Accordingly, the various components or features of the present invention (including the fastening portions and any other components or features described or envisioned herein) may incorporate any of these other materials as fastening materials to be used in conjunction with hook-and-loop material, which may provide for removable attachment of a still broader array of components to one another. In these and other aspects, the fastening portions and associated components of the present invention may be custom-tailored for use with countless garments or other articles in still further applications.

For example, the one or more fastening portions may include a single length of the hook-and-loop material. Alternatively, or in addition, the one or more fastening portions may include any number of patches. The patches may include the hook-and-loop material. The hook-and-loop material may have any height and/or length. For example, the hook-and-loop material may have a height between approximately one and five inches (or any other height). Where the one or more fastening portions include a single length, the length may correspond to a circumference or other dimension of the garment (e.g., measured about a waistband or pocket of the garment). Where the one or more fastening portions include the patches, the patches may each have a length between approximately two and eight inches (or any other length). The single length or the patches may be designed to be secured to the interior portion of the garment in an orientation defining one or more spacings between separate or unconnected ends of the single length or the patches and one or more opening or separation locations of the garment.

The hook-and-loop material may have a first stretch characteristic. The garment may have a second stretch characteristic. The first stretch characteristic may be within a stretch threshold of the second stretch characteristic. The one or more fastening portions may be designed to be secured to the interior portion of the garment by stitching, for example, in a box-stitch pattern, a zigzag-stitch pattern, or a bar tack or tacking pattern.

The one or more accessories may include at least one of a pouch, a sheath, a holster, a utility belt, a magazine pouch, and/or any other accessory. Each accessory may include a main portion and/or one or more accessory-fastening portions. The one or more accessory-fastening portions may be securable to the main portion and may be designed to be removably attached to the one or more fastening portions of the accessory restraint system. The one or more accessory-fastening portions may each include the hook-and-loop material or a fastening material that is removably attachable to the hook-and-loop material. The one or more accessory-fastening portions (as well as any material from which each accessory-fastening portion is fully or partially composed, e.g., hook-and-loop material or another fastening material) may have any shape (e.g., dots, stripes, rectangle, triangle, circle or oval, etc.) and may define a coverage area that may be less than or equal to a surface area of the main portion. The main portion may also have any shape (e.g., triangular, circular, rectangular, asymmetrical, etc.), volume, and surface area. The one or more accessory-fastening portions may be permanently securable to the main portion, for example, by stitching, gluing, or bonding. Alternatively, or in addition, each accessory may include one or more mounted attachments including the one or more accessory-fastening portions. The one or more mounted attachments may be permanently or removably securable to the main portion, for example, by one or more fasteners. The one or more mounted attachments may be rotatable, with respect to the main portion, about the one or more fasteners.

The garment may be a bottom garment or any other garment wearable by a user. The interior portion of the garment may be a waistband, a pocket, or any other part of the garment defining an interior volume of the garment. The one or more fastening portions may be designed to be secured to the interior portion of the garment at one or more attachment locations to prevent the one or more accessories from printing or displaying one or more outlines on an exterior portion of the garment while the one or more accessories are attached to the one or more fastening portions at the one or more attachment locations.

An accessory restraint system securable to a garment in accordance with one or more aspects of the present disclosure may be manufactured via a method that generally includes providing a garment, providing one or more fastening portions, and securing the one or more fastening portions to an interior portion of the garment. One or more accessories may be removably attachable to the one or more fastening portions and may further be provided. The method may further include applying a garment-washing technique to the garment. The one or more fastening portions may be secured to the interior portion of the garment by stitching in a pattern such as a box-stitch pattern, a zigzag-stitch pattern, or a bar tack or tacking pattern. The stitching may be performed manually, either by a folder attachment for a sewing machine or by a sewing machine with a sewing foot, based at least in part on the garment-washing technique applied to the garment.

An accessory restraint system in accordance with the present disclosure may offer numerous improvements over existing means of retaining an accessory about a garment. For example, the accessory restraint system may create retention about an inner circumference of apparel bottoms or other garments, rather than about an outer circumference. Moreover, by using modular retention means such as fastening portions that include hook-and-loop material, the accessory restraint system may provide for improved compatibility with a greater range of accessories, namely, any accessory compatible with the retention means. Accordingly, the accessory restraint system described herein may provide substantial improvements over existing retention systems, as described in further detail below.

Referring now to FIGS. 1A-1F, and in brief overview, accessory restraint system 100 may include one or more fastening portions (e.g., fastening portions 102, 136, 140, 146, 154, and/or 162) and may further be securable to garment 104. For example, fastening portions 102, 136, 140, 146, 154, and/or 162 may be designed to be secured to interior portion 122 of garment 104. Garment 104 may be composed, in whole or in part, of base garment material 106 and may be wearable by a user (e.g., a human or an animal). Accessory restraint system 100 may be designed such that one or more accessories may be removably attachable to fastening portions 102, 136, 140, 146, 154, and/or 162, which may facilitate, for instance, improved utility, storage, carrying, retention, customization, configuration, concealment, or removal functionality of garment 104 when garment 104 is worn or otherwise used by a user. Accessories may include various components and equipment such as firearm (or other) holsters, storage or carrying bags or pockets, ammunition (or other) pouches, belts, knife (or other) sheathes, phone cases, wallets, eyewear cases, flashlights, tool cases, utility or battle belts, supplemental attachment components (e.g., fasteners, loops, buttons, straps, or carabiners), or any other components or equipment that may be removably attachable to any of the fastening portions described herein. Example accessories 200, 300, 400, 502, and 600A and 600B are shown in FIGS. 2A and 2B, 3A-3C, 4A-4C, 5, and 6A-6C, respectively, which are described in further detail below. It will be understood, in view of the significant range of garments and accessories that may be compatible with accessory restraint system 100, that various components, features, and characteristics of accessory restraint system 100 described herein are merely illustrative and should not at all be construed as limiting the scope of the present invention. As just one example, any of fastening portions 102, 136, 140, 146, 154 and 162 may have any components, features, or characteristics of any other fastening portion described or otherwise provided for by the present disclosure. Similar may be said with respect to any other component, feature, or characteristic of accessory restraint system 100, as well as the various accessories associated therewith.

As shown in FIG. 1A, garment 104 may be pair of jeans 108. Alternatively, garment 104 may be any bottom garment, top garment, or any article suitable for wearing as a garment by a user. For example, garment 104 may be a pair of shorts, pants, slacks, trousers, underpants, Bermuda pants, britches, breeches, trousers, chaps, chinos, corduroys, pantaloons, joggers, yoga pants, sweatpants, athletic pants, or suspenders, a skirt, a dress, a shirt, a vest, a jacket, a poncho, a suit, or a coverall. Garment 104 may be composed, in whole or in part, of base garment material 106, which may be any material suitable for use as a garment material. Base garment material 106 may, for instance, include denim, khaki, cotton, twill, corduroy, canvas, nylon, or polyester. It is well understood that the list of garments or other articles wearable by a user is quite extensive, as is the variety of materials from which such garments may be composed. Accordingly, the scope of garment 104 and base garment material 106 considered herein should not be construed as limited in any way by the present examples.

As shown throughout FIGS. 1A-1F, accessory restraint system 100 may be dimensionally and/or characteristically compatible with garment 104. For example, a respective length of each fastening portion of accessory restraint system 100 (e.g., length 110 of fastening portion 102 in FIG. 1A, length 168 of fastening portion 136 in FIG. 1B, length 142 of fastening portion 140 in FIG. 1C, length 148 of fastening portions 146 in FIG. 1D, length 156 of fastening portions 154 in FIG. 1E, and length 166 of fastening portion 162 in FIG. 1F) may be limited or otherwise informed by one or more inner dimensions of garment 104, such as inner circumference 112 of waistband 114 of pair of jeans 108 (see FIGS. 1A-1E) or by another design feature of garment 104 such as opening or separation location 152 of pair of jeans 108 (see FIG. 1D). As such, each fastening portion may be designed or otherwise selected such that its length fits with garment 104.

Figure 1B:
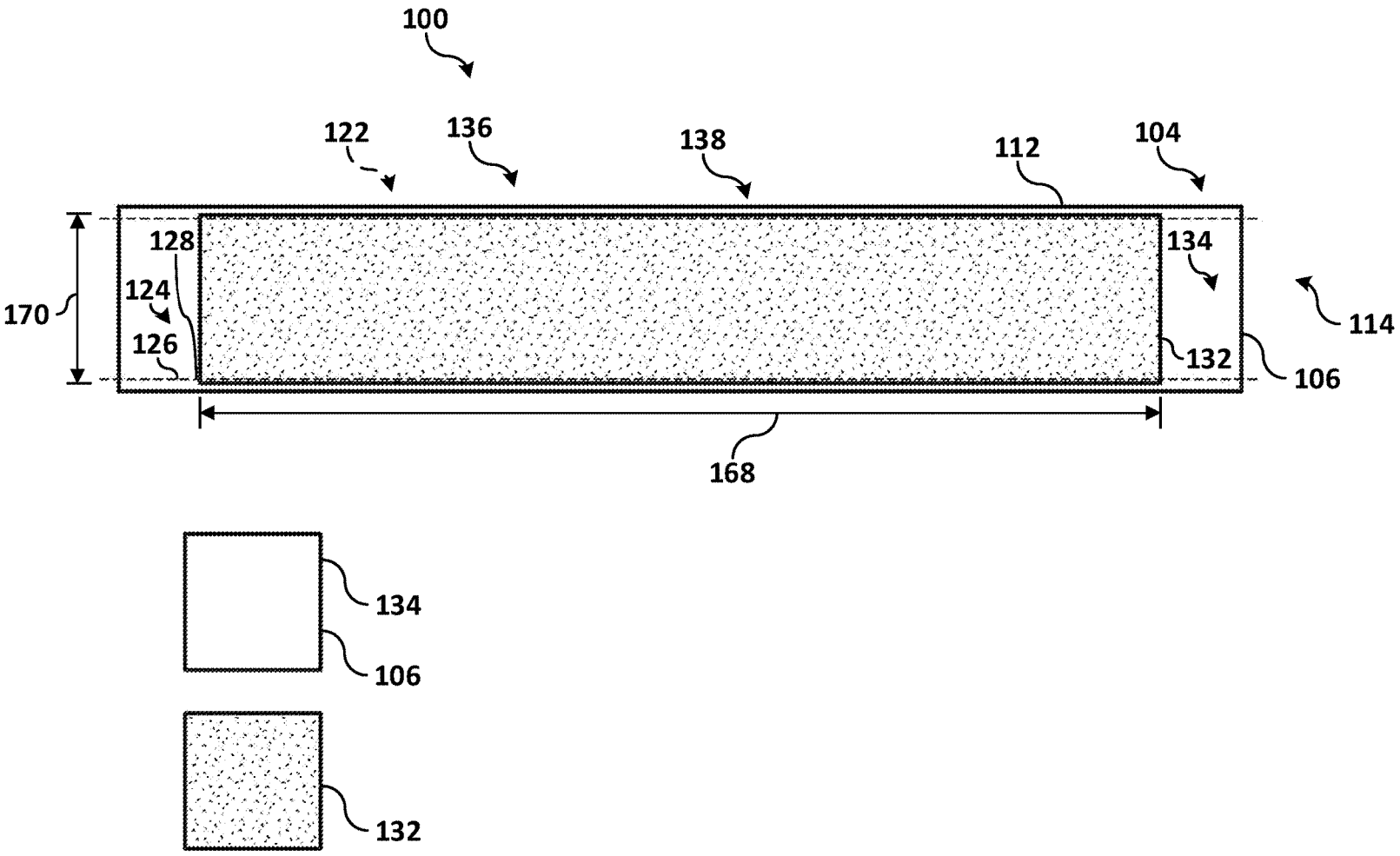
Figure 1D:
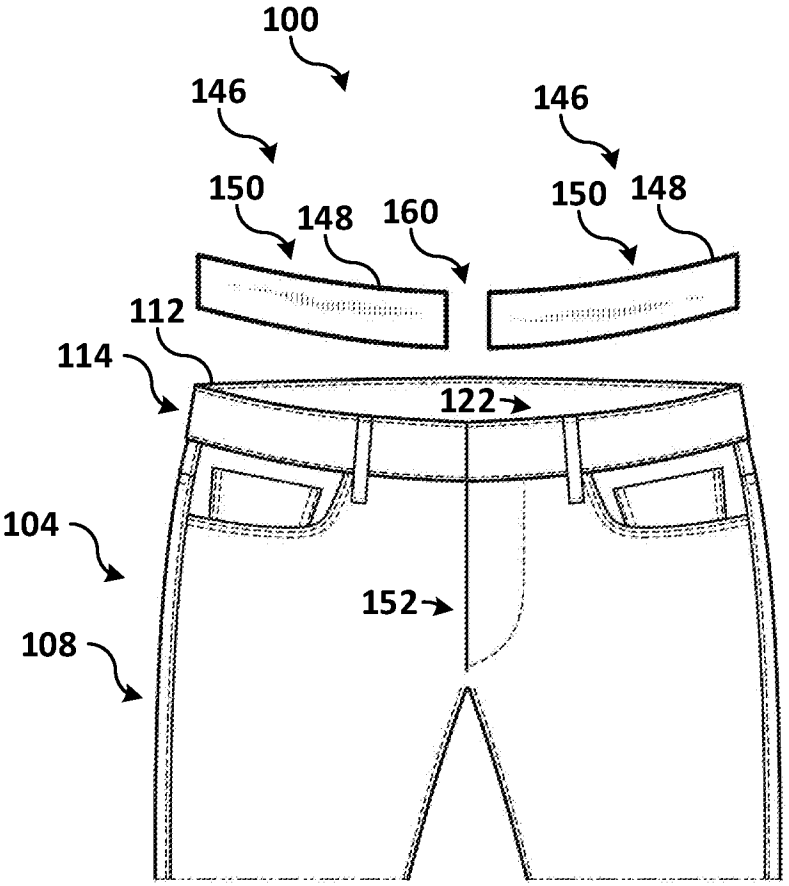
Figure 1C:
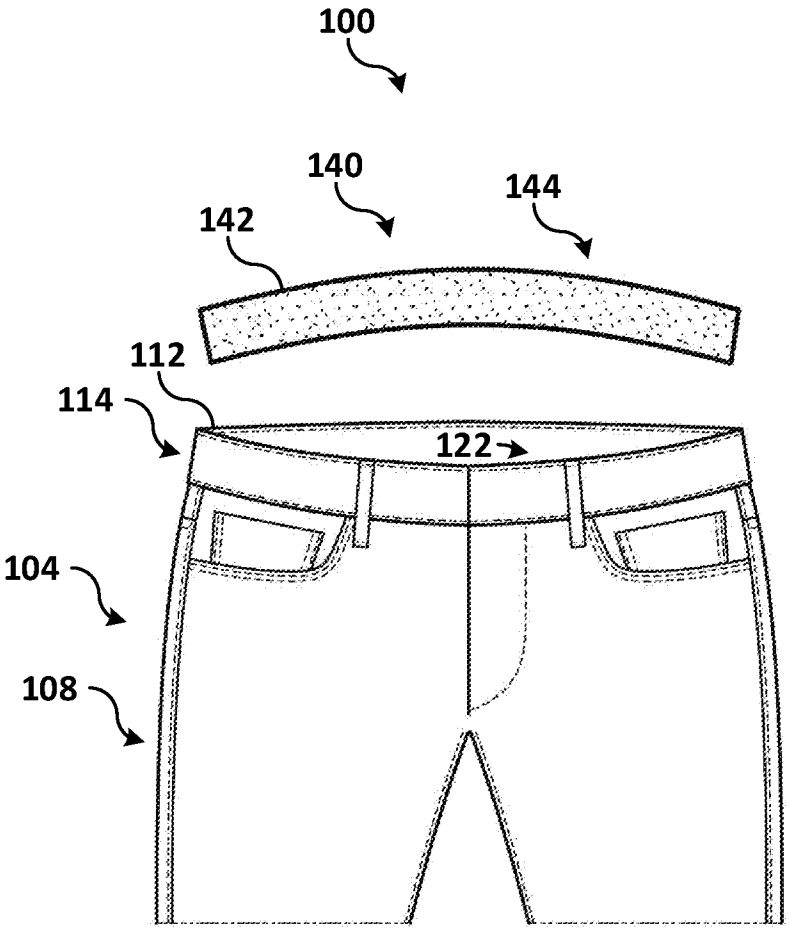
Figure 1E:
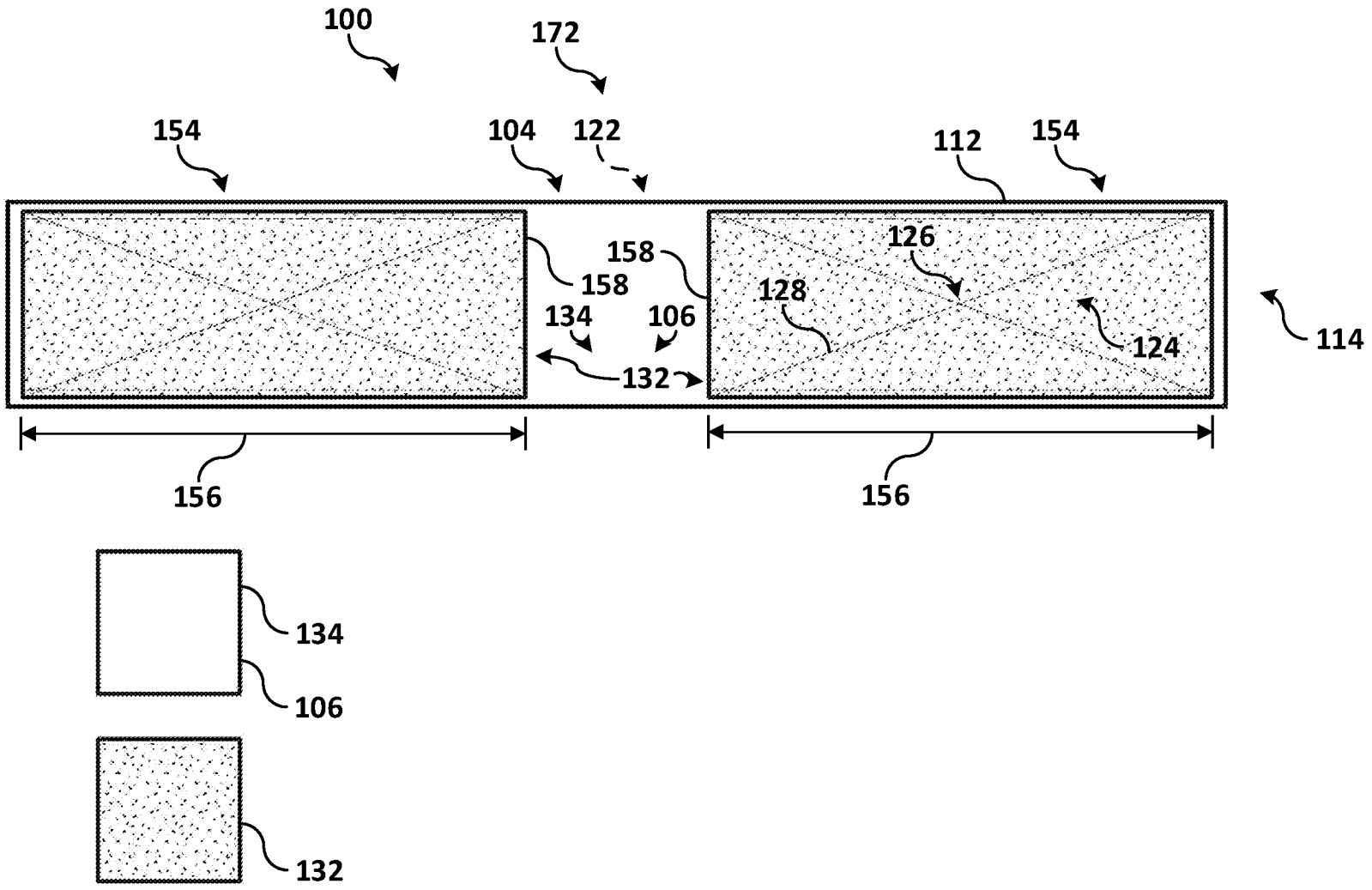

As just some of numerous examples, fastening portions 102, 136, 140, and 162 may each be designed as a single length of material (see FIGS. 1A-1C and 1F), whereas fastening portions 146 and 154 may each include multiple patches of material having the same or different lengths with respect to one another (see FIGS. 1D and 1E). Each fastening portion may have any length compatible with various dimensions of garment 104. For example, as shown in FIG. 1A, fastening portion 102 may have length 110, which may approximately correspond to inner circumference 112 of pair of jeans 108, thereby providing for the greatest surface area with which to attach one or more accessories to fastening portion 102 and/or to secure accessory restraint system 100 to garment 104.

Alternatively, as shown in FIGS. 1C and 1D, fastening portions 140 or 146 may have respective lengths 142 or 148, which may each be less than inner circumference 112 of pair of jeans 108 for various economic, aesthetic, comfort, or functional purposes. Fastening portion 140 in FIG. 1C, for instance, may only extend about the rear half of inner circumference 112, which may provide sufficient surface area for accessory-retention purposes in a comparably discreet and comfortable location of garment 104. Fastening portions 146 in FIG. 1D may each extend about a front quarter of inner circumference 112, which may provide a similar amount of collective surface area for accessory-retention purposes while providing spacing or break 160 between fastening portions 146 in order to accommodate opening or separation location 152. Opening or separation location 152 is illustrated as a fly or front opening of pair of jeans 108 in FIG. 1D; however, it will be understood that opening or separation location 152 may be any location where garment 104 may be opened or separated, either fully or partially, via zipper, buttons, snaps, hook-and-loop material, magnets, or any other openable or separable component that may be associated with garment 104.

Figure 1F:
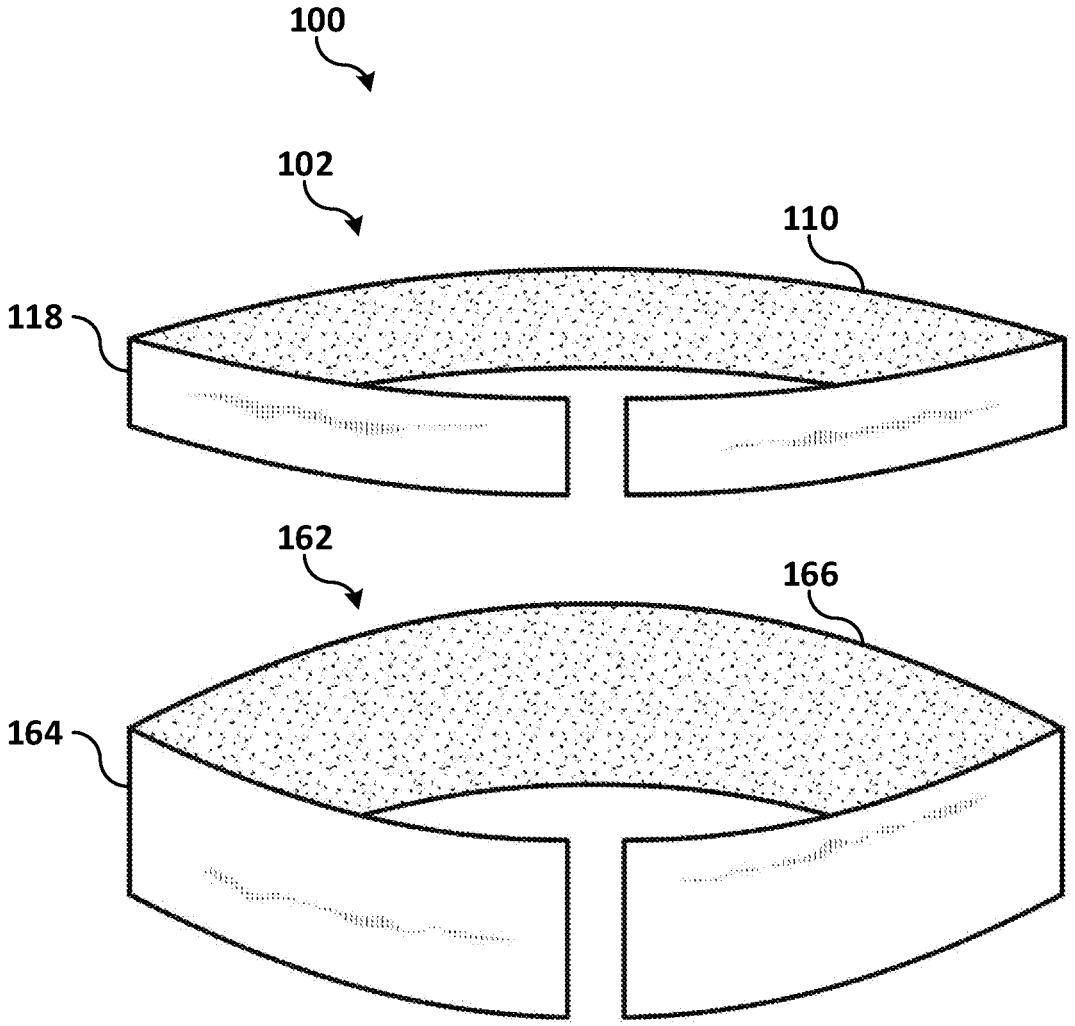

Similarly, a respective height of each fastening portion of accessory restraint system 100 (e.g., height 118 of fastening portion 102 in FIGS. 1A and 1F, height 170 of fastening portion 136 in FIG. 1B, or height 164 of fastening portion 162 in FIG. 1F) may be any height that is compatible with one or more inner dimensions of garment 104 and provides for a sufficient quantity or surface area of the fastening portion such that one or more accessories may be removably attached to the fastening portion. For example, the respective heights of any of the fastening portions described or otherwise envisioned herein may be a minimum of one-half inch (0.5 in.) without having any maximum limit. Depending on a type of garment 104, the height of a fastening portion may range in some cases from approximately one to six inches (1-6 in.) and may or may not correspond to a stock or nominal material size (e.g., 1 in., 1.25 in., 1.5 in., and so forth, up to 6 in.). As shown in FIGS. 1A, 1B, and 1F, height 118 of fastening portion 102 and/or height 170 of fastening portion 136 may be approximately one to two-and-a-half inches (1-2.5 in.), which may correspond within a preferred tolerance of one or more inner dimensions of waistband 114 of pair of jeans 108 (e.g., placed directly atop waistband 114). Alternatively, height 164 of fastening portion 162 may be approximately three to six inches (3-6 in.), which may correspond within a preferred tolerance of one or more inner dimensions of, for instance, a garment lacking a waistband (e.g., located about a full internal circumference of board shorts or "tummy tuck" yoga pants). Moreover, two or more fastening portions may be oriented about interior portion of 122 of garment 104 with one fastening portion higher than the other, or "stacked," which may provide for still further optimization of accessory restraint system 100 for use with garment 104.

The dimensions, including lengths and heights, of the various fastening portions described or otherwise envisioned herein may be further based, at least in part, on a balance of economic and functional considerations. For example, any length or height may be selected based on a supply of off-the-shelf materials having nominal lengths or heights due to cost-efficiency or ready availability. Alternatively, fastening portions may be designed with materials having custom lengths or heights by combining or shortening available pieces of material or by custom-ordering materials having such dimensions. It will be understood that such customization may further expand the range of garments with which accessory restraint system 100 may be compatible, albeit potentially at an increased cost versus using off-the-shelf components. Countless compromises may also be made in this regard between cost and functionality. As just one of many examples, fastening portions 154 in FIG. 1E may each include a patch of material having a stock height (e.g., 1 in., 1.5 in., 3 in., 5 in., and so forth) and length 156 between approximately two and eight inches (2-8 in.), which may be cut down from a longer length of stock material or otherwise provided at the preferred length. Fastening portions 154 may be secured to garment 104 in a pattern, for instance, about inner circumference 112 of garment 104, with spacing 172 between each fastening portion 154. In this manner, accessory restraint system 100 may require comparatively less material to form fastening portions 154 and/or provide for improved comfort or pliability of garment 104 when secured to accessory restraint system 100, all while providing a similar degree of retention as might be possible had a fastening portion with a single length been used instead.

The various fastening portions described or envisioned herein may define or otherwise be associated with any number of segments (e.g., the patches described above with respect to fastening portions 154 in FIG. 1E), which may provide for further optimization of accessory restraint system 100 with respect to garment 104. For example, fastening portion 102 in FIGS. 1A and 1F, fastening portion 136 in FIG. 1B, and fastening portion 140 in FIG. 1C, may each define or otherwise be associated with one segment (respectively, segments 120, 138, 144), whereas fastening portions 146 in FIG. 1D and fastening portions 154 in FIG. 1E may define or otherwise be associated with multiple segments (respectively, segments 150 and 158). Each segment may extend substantially around interior portion 122 of garment 104 or may be located, along with one or more other segments, at any number of points or distances about interior portion 122 of garment 104. It will be understood that each fastening portion may individually define or be associated with a single or multiple segments, or multiple fastening portions may together define or be associated with a single or multiple segments, depending on the particular embodiment of the present invention.

Accessory restraint system 100 may be designed such that any of the fastening portions described or envisioned herein may be accessible from interior portion 122 of garment 104. Accordingly, one or more accessories may be removably attachable proximate to interior portion 122, which may provide for improved utility, storage, carrying, retention, customization, configuration, concealment, or removal of the one or more accessories in relation to garment 104. In other words, accessory restraint system 100 may improve upon existing accessory restraint technology by providing a more universal system for removably attaching one or more accessories in a manner compatible with garment 104. The design of accessory restraint system 100 may, for instance, be such that one or more fastening portions may be secured to interior portion 122 of garment 104 at one or more attachment locations in an orientation that prevents accessories, while attached to the fastening portions at the attachment locations, from printing or displaying outlines on an exterior portion of garment 104. For example, as shown in FIG. 1A, wherein garment 104 may be pair of jeans 108, fastening portion 102 of accessory restraint system 100 may be accessible from, and accessories may be attachable at attachment locations around, interior portion 122 located about waistband 114. Accordingly, a user may removably attach one or more accessories to fastening portion 102 such that the one or more accessories may be preferably configured in a concealed yet accessible orientation with respect to pair of jeans 108. Although interior portion 122 is generally presented herein as an interior volume defined by waistband 114 of garment 104, it will be understood that interior portion 122 may be any feature of garment 104 that defines an interior volume (e.g., a pocket or hood).

As shown in FIGS. 1B and 1E, accessory restraint system 100 may be securable to garment 104 via attachment means 124. Attachment means 124 may be any means suitable for securing one or more fastening portions (e.g., fastening portion 136 in FIG. 1B or fastening portion 154 in FIG. 1E) to base garment material 106 of garment 104. For example, attachment means 124 may include stitching, gluing, ironing (e.g., heat-activated gluing by ironing), fastening, riveting, bonding, adhesive, or sewing elements 126. With respect to embodiments where attachment means 124 includes sewing elements 126, any thread material 128 suitable for securing fastening portions to base garment material 106 (e.g., standard Tex 80 bonded polyester/cotton thread) may be used. Different thread materials 128 may also be used depending on desired cost, strength, durability, environmental compatibility, etc. As to embodiments including sewing elements 126, thread material 128 may be sewn to base garment material 106 of garment 104 using any suitable sewing method. For example, as shown in FIG. 1B, a chain-stitch pattern may be applied along the edges of fastening portion 102, or, as shown in FIG. 1E, a box-stitch pattern may be applied across the surface of fastening portions 154. As yet other options, a zig-zag stitch pattern (e.g., top to bottom) or a bar tack or tacking pattern may be applied along any fastening portion described or envisioned herein.

As shown throughout FIGS. 1A-1F, any fastening portion of accessory restraint system 100 may include any material or component suitable for removable attachment of one or more compatible accessories. For example, any of fastening portions 102, 136, 140, 146, 154, and/or 162 may include hook-and-loop material 132 or another fastening material that is removably attachable to hook-and-loop material 132. Alternatively, or in addition, any fastening portion may include one or more buttons, magnets, reusable adhesive materials, clips, snaps, and so forth. Any fastening portion may be composed, in whole or in part, of material compatible with attachment means 124 and, by extension, with base garment material 106.

Fastening portions may have any configuration compatible with attachment means 124 and, accordingly, with garment 104. For example, in embodiments where garment 104 includes a waistband such as waistband 114 (e.g., various garment bottoms), each fastening portion may include one or more segments of hook-and-loop material 132 having dimensions such that the height and length of accessory restraint system 100 may correspond to one or more inner dimensions of waistband 114. As such, the segments may be sewn along interior portion 122 of garment 104 about waistband 114, while hook-and-loop material 132 may remain substantially accessible to the user via interior portion 122 of garment 104. For example, segments of hook-and-loop material 132 may be sewn to base garment material 106 about waistband 114 by applying a chain-stitch pattern at a distance of approximately one-sixteenth to one-eighth of an inch (1/16-1/8 in.) from the top and bottom edges of each segment, or by applying any other stitch pattern (including but not limited to those described herein), which may effectively secure accessory restraint system 100 to garment 104 in a discreet manner while allowing the user to removably attach one or more accessories to hook-and-loop material 132.

As shown in FIG. 1A, garment 104 may be pair of jeans 108. As further shown in FIGS. 1B and 1E, base garment material 106 may be denim 134. As shown in FIG. 1B, fastening portion 136 of accessory restraint system 100 may include one segment 138 including hook-and-loop material 132, which may extend substantially about interior portion 122 of waistband 114 of pair of jeans 108. Attachment means 124 may include sewing elements 126, and thread material 128 may be sewn in a chain-stitch pattern along the edges of segment 138 of fastening portion 136. As shown in FIG. 1E, fastening portions 154 of accessory restraint system 100 may collectively include multiple segments 158, each including hook-and-loop material 132, which may extend substantially about interior portion 122 of waistband 114 of pair of jeans 108. Attachment means 124 may include sewing elements 126, and thread material 128 may be sewn in a box-stitch pattern about the surfaces of segments 158 of fastening portions 154. As such, hook-and-loop material 132 may be secured to denim 134 while remaining substantially accessible to the user for purposes of removably attaching one or more accessories when pair of jeans 108 are worn or otherwise used.

Hook-and-loop material 132 may have a stretch characteristic based on its design or composition. Garment 104 may also have a stretch characteristic based on its own design or composition. The stretch characteristic corresponding to hook-and-loop material 132 may be within a stretch threshold of the stretch characteristic corresponding to garment 104, which may provide for improved compatibility between accessory restraint system 100 and garment 104. For example, hook-and-loop material 132 may be a VELCRO®-brand hook-and-loop material such as VEL-STRETCH® stretch loop material (or any other material having similar stretch characteristics), which may be capable of stretching a similar amount compared to a material of garment 104. As such, accessory restraint system 100 may be more readily securable to garment 104 about fastening portions including hook-and-loop material 132.

Figure 2B:
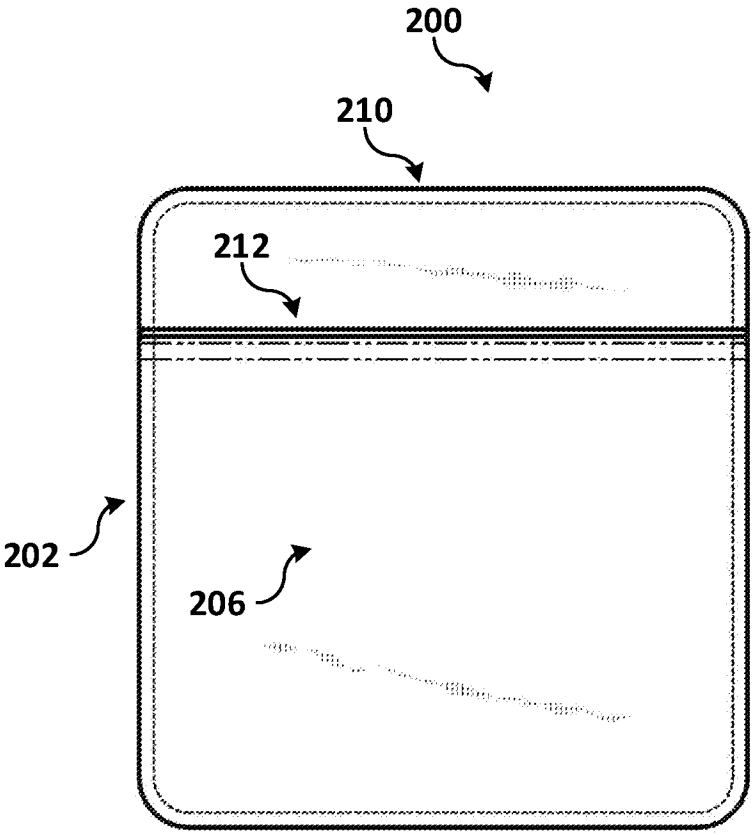
FIGS. 2A and 2B are, respectively, rear and front views of an accessory, attachable to an accessory restraint system, in accordance with one or more aspects of the present disclosure.
Figure 2A:
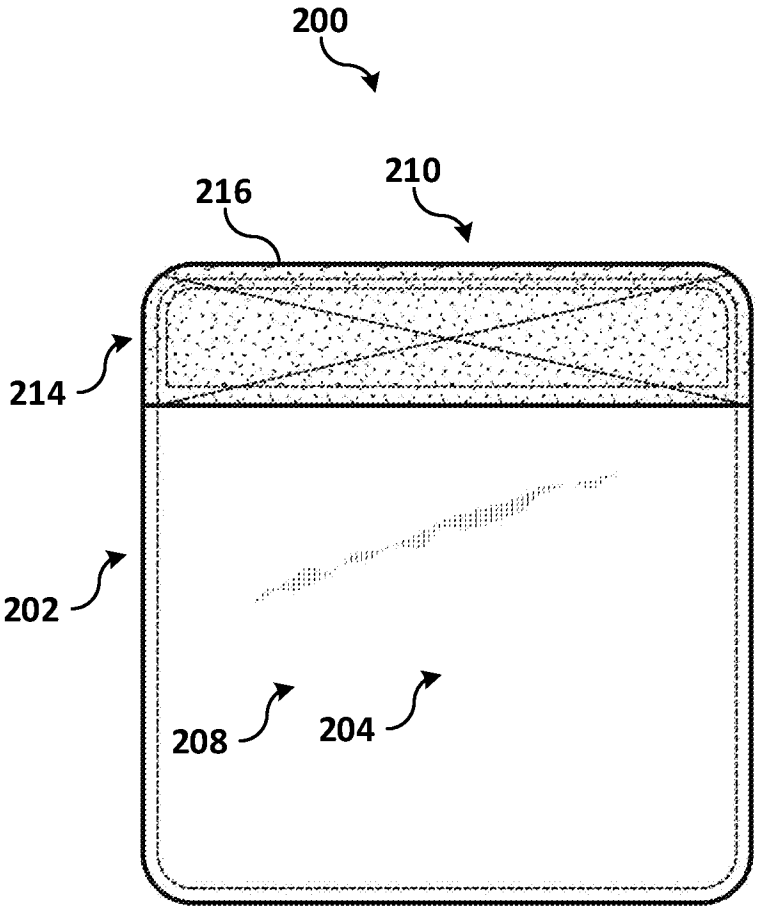

Referring now to FIGS. 2A and 2B, and in brief overview, accessory 200 may include removable pouch 202, which may be designed in any shape or size suitable for use as a pouch. Removable pouch 202 may be made, in whole or in part, of pouch material 204, which may be any material suitable for use as a pouch (e.g., Kydex, Boltaron®, leather, Tegris®, nylon, elastic, woven, knit, or Tweave-type material). Removable pouch 202 may include front surface 206, rear surface 208, top portion 210, and pouch opening 212. Pouch opening 212 may be designed to receive a range of items suitable for storage or carrying in a pouch.

As shown in FIG. 2A, removable pouch 202 may further include accessory-fastening portion 214, which may be compatible with one or more fastening portions of accessory restraint system 100 (see FIGS. 1A-1F). Accordingly, accessory 200 may be removably attachable to accessory restraint system 100 (see FIGS. 1A-1F). For example, accessory-fastening portion 214 may include hook-and-loop material 216 or another fastening material, which may be removably attachable to hook-and-loop material 132 used with accessory restraint system 100 (see FIGS. 1A-1F). Accessory-fastening portion 214 may be secured to pouch material 204 on rear surface 208 of removable pouch 202 using any suitable means of attachment. For example, accessory-fastening portion 214 may include hook-and-loop material 216 sewn or bonded to pouch material 204 on rear surface 208 proximate to top portion 210 of removable pouch 202. Alternatively, or in addition, accessory-fastening portion 214 may be secured to pouch material 204 using various means similar to attachment means 124 (see FIGS. 1B and 1E).

As shown in FIG. 2B, pouch opening 212 may be located proximate to top portion 210 on front surface 206 of removable pouch 202. Accordingly, the user may use removable pouch 202, for example, when accessory 200 is removably attached to accessory restraint system 100 (see FIGS. 1A-1F).

Figure 3A:
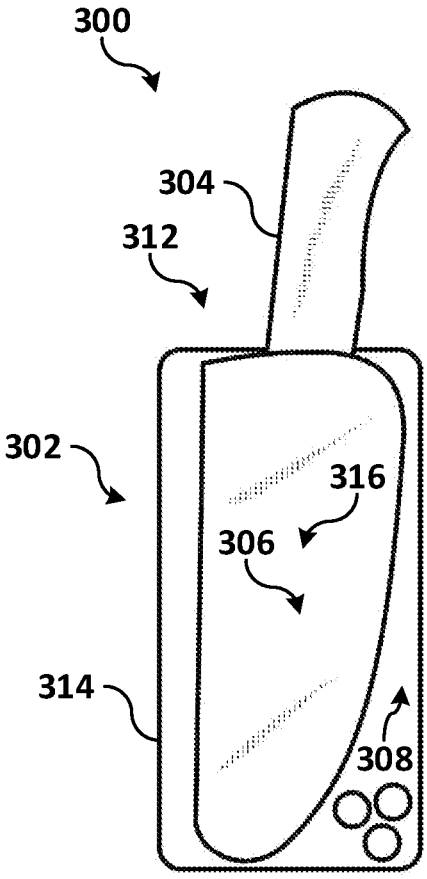
FIGS. 3A and 3B are, respectively, front and rear views of an accessory, attachable to an accessory restraint system, in accordance with one or more aspects of the present disclosure.
Figure 3B:
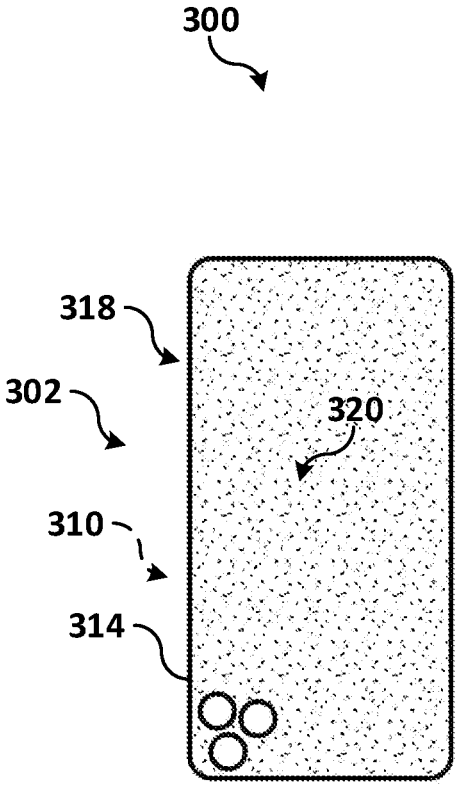
Figure 3C:
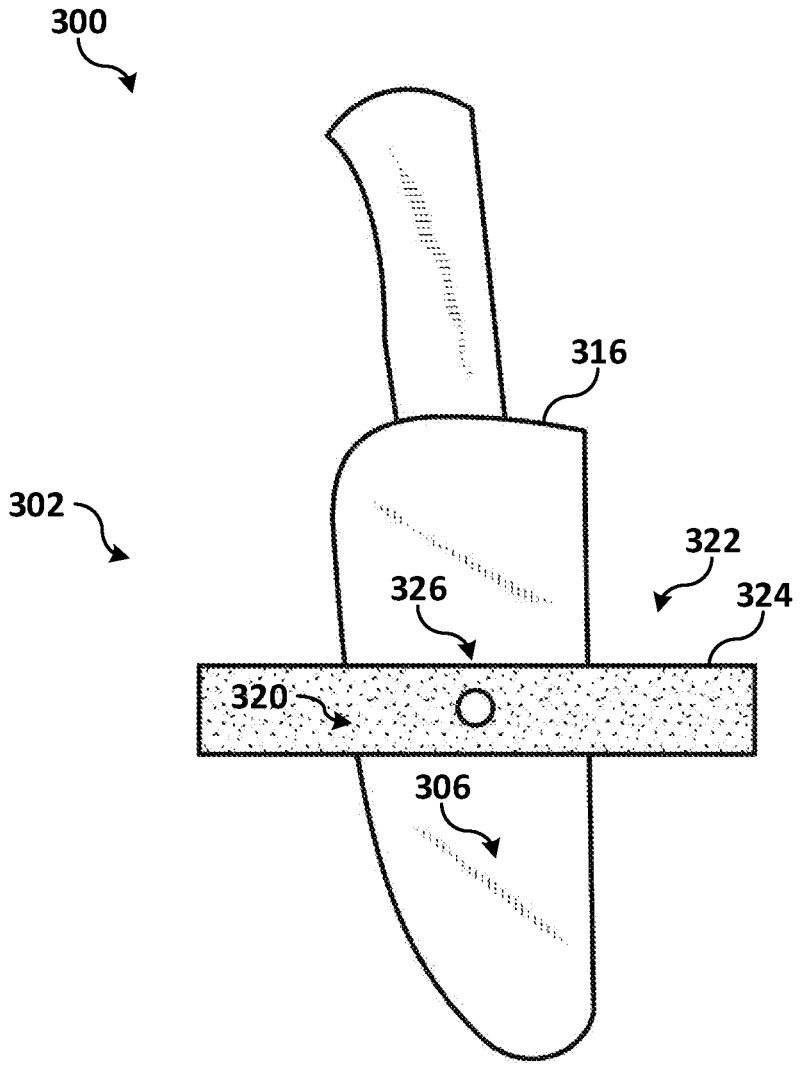
FIG. 3C is a rear view of an accessory, attachable to an accessory restraint system, in accordance with one or more aspects of the present disclosure.

Referring now to FIGS. 3A-3C, and in brief overview, accessory 300 may include removable knife sheath 302, which may be designed in any shape or size suitable for use as a sheath for knife 304. Removable knife sheath 302 may be made, in whole or in part, of sheath material 306, which may be any material suitable for use as a sheath (e.g., synthetic material, leather, Boltaron®, Tegris®, Kydex or other thermoplastics, nylon, elastic, woven, knit, or Tweave-type material). Removable knife sheath 302 may include front surface 308, rear surface 310, and top portion 312.

As shown in FIG. 3A, removable knife sheath 302 may be designed to receive knife 304 about top portion 312. For example, removable knife sheath 302 may include base plate 314 and sheath 316. Base plate 314 and/or sheath 316 may be made of sheath material 306, which may be, for instance, a thermoplastic such as Kydex (or any other material). Sheath 316 may be integral to base plate 314 or may be bonded to base plate 314, for instance, with glue, resin, hardening agents, sewing, and/or any other means of bonding. Sheath 316 may be designed to carry knife 304, which may also contact base plate 314. Front surface 308 may be designed to proximately contact the user during use of accessory 300, as further described below.

As shown in FIG. 3B, removable knife sheath 302 may further include accessory-fastening portion 318, which may be compatible with one or more fastening portions of accessory restraint system 100 (see FIGS. 1A-1F). Accordingly, accessory 300 may be removably attachable to accessory restraint system 100 (see FIGS. 1A-1F), which may allow the user to access knife 304 while removable knife sheath 302 is proximate to interior portion 122 of garment 104 (see FIGS. 1A-1F). For example, accessory-fastening portion 318 may include hook-and-loop material 320 or another fastening material, which may be removably attachable to hook-and-loop material 132 (see FIGS. 1A-1F). Accessory-fastening portion 318 may be secured to sheath material 306 on rear surface 310 of removable knife sheath 302 using any suitable means of attachment. For example, accessory-fastening portion 318 may include hook-and-loop material 320 secured via bonding or adhesive to sheath material 306 about base plate 314 on rear surface 310 of removable knife sheath 302. Alternatively, or in addition, accessory-fastening portion 318 may be secured to sheath material 306 using various means similar to attachment means 124 (see FIGS. 1B and 1E). Base plate 314 may be substantially flat to provide for improved securing of accessory-fastening portion 318 to sheath material 306 about base plate 314.

As shown in FIG. 3C, removable knife sheath 302 may be used with means for removably attaching accessory 300 to accessory restraint system 100 (see FIGS. 1A-1F) other than accessory-fastening portion 318 secured directly to sheath material 306 on rear surface 310 of removable knife sheath 302. For example, accessory 300 may further include mounted attachment 322. Mounted attachment 322 may have any shape or dimensions. For example, mounted attachment 322 may be a square, rectangular, or round shape having any dimensions. Mounted attachment 322 may be composed of any one or more materials. For example, materials from which mounted attachment 322 may be composed include Kydex, Boltaron®, Tegris®, and/or any other synthetic or natural material.

Mounted attachment 322 may include accessory-fastening portion 324. Hook-and-loop material 320 or another fastening material may be included in or secured to accessory-fastening portion 324, for instance, via mounting or bonding with glue, resin, hardening agents, sewing, and/or any other bonding means. Hook-and-loop material 320 or the other fastening material may be removably attachable to hook-and-loop material 132 of accessory restraint system 100 (see FIGS. 1A-1F). As such, mounted attachment 322 may be removably attachable to any fastening portion of accessory restraint system 100 (see FIGS. 1A-1F).

Mounted attachment 322 may be permanently or removably secured to sheath 316 by one or more fasteners 326. For example, fastener 326 may be a rivet, dowel, screw, or any other fastener or fastener-type material. Fastener 326 may secure mounted attachment 322 to sheath 316 in a fixed or movable manner. For example, mounted attachment 322 may be fixed with respect to sheath 316 or may be rotatable, with respect to sheath 316, about fastener 326. In this manner, mounted attachment 322 may provide for removable knife sheath 302 to be ergonomically secured about garment 104 (see FIGS. 1A-1E), regardless of garment type.

Figure 4B:
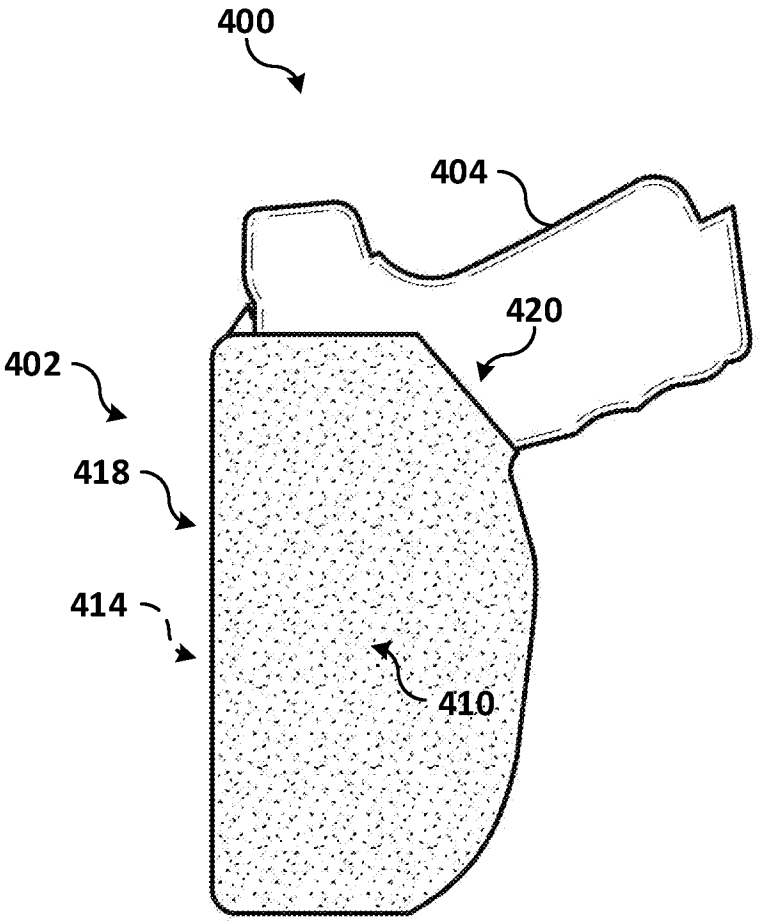
FIGS. 4A and 4B are, respectively, front and rear views of an accessory, attachable to an accessory restraint system, in accordance with one or more aspects of the present disclosure.
Figure 4A:
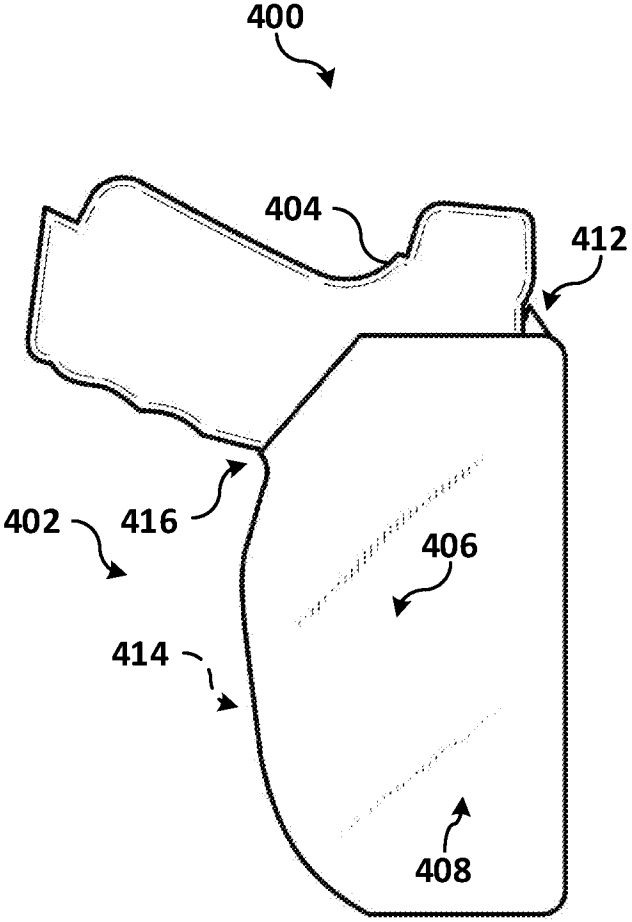
Figure 4C:
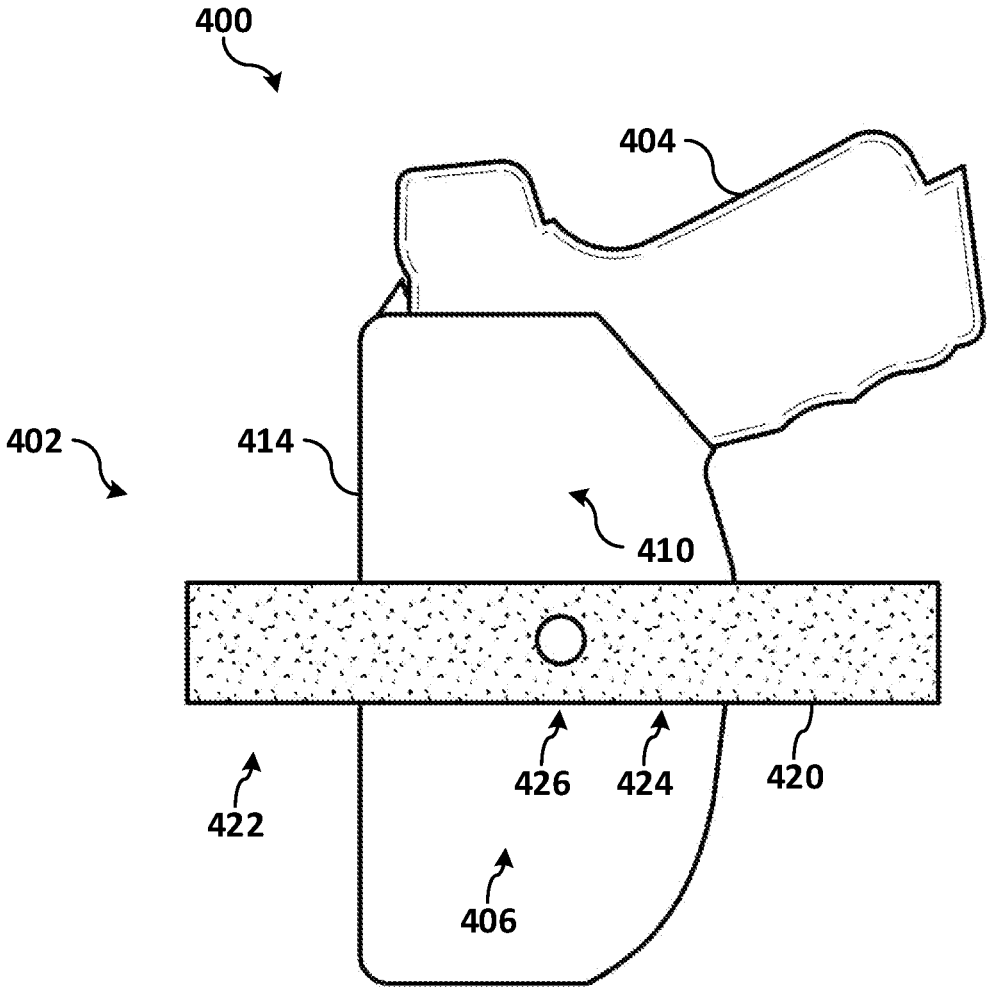
FIG. 4C is a rear view of an accessory, attachable to an accessory restraint system, in accordance with one or more aspects of the present disclosure.

Referring now to FIGS. 4A-4C, and in brief overview, accessory 400 may include removable firearm holster 402, which may be designed in any shape or size suitable for use as a holster for firearm 404. Removable firearm holster 402 may be made, in whole or in part, of holster material 406, which may be any material suitable for use as a holster (e.g., synthetic material, leather, Boltaron®, Tegris®, Kydex or other thermoplastics, nylon, elastic, woven, knit, or Tweave-type material). Removable firearm holster 402 may include front surface 408, rear surface 410, and top portion 412.

As shown in FIG. 4A, removable firearm holster 402 may be designed to receive firearm 404 about top portion 412. For example, removable firearm holster 402 may include base 414 and carrying element 416. Base 414 and/or carrying element 416 may be made of holster material 406, which may be, for instance, a thermoplastic such as Kydex or Boltaron® (or any other material). Carrying element 416 may be any feature or component designed to carry firearm 404, which may also contact base 414. Front surface 408 may be designed to proximately contact the user during use of accessory 400, as further described below.

As shown in FIG. 4B, removable firearm holster 402 may further include accessory-fastening portion 418, which may be compatible with one or more fastening portions of accessory restraint system 100 (see FIGS. 1A-1F). Accordingly, accessory 400 may be removably attachable to accessory restraint system 100 (see FIGS. 1A-1F), which may allow the user to access firearm 404 while removable firearm holster 402 is proximate to interior portion 122 of garment 104 (see FIGS. 1A-1F). For example, accessory-fastening portion 418 may include hook-and-loop material 420 or another fastening material, which may be removably attachable to hook-and-loop material 132 (see FIGS. 1A-1F). Accessory-fastening portion 418 may be secured to holster material 406 on rear surface 410 of removable firearm holster 402 using any suitable means of attachment. For example, accessory-fastening portion 418 may include hook-and-loop material 420 secured via bonding or adhesive to holster material 406 about base 414 on rear surface 410 of removable firearm holster 402. Alternatively, or in addition, accessory-fastening portion 418 may be secured to holster material 406 using various means similar to attachment means 124 (see FIGS. 1B and 1E). Base 414 may be substantially flat to provide for improved securing of accessory-fastening portion 418 to holster material 406 about base 414.

As shown in FIG. 4C, removable firearm holster 402 may be used with means for removably attaching accessory 400 to accessory restraint system 100 (see FIGS. 1A-1F) other than accessory-fastening portion 418 secured directly to holster material 406 on rear surface 410 of removable firearm holster 402. For example, accessory 400 may further include mounted attachment 422. Mounted attachment 422 may have any shape or dimensions. For example, mounted attachment 422 may be a square, rectangular, or round shape having any dimensions. Mounted attachment 422 may be composed of any one or more materials. For example, materials from which mounted attachment 422 is composed may include Kydex, Boltaron®, Tegris®, and/or any other synthetic or natural material.

Mounted attachment 422 may include accessory-fastening portion 424. Hook-and-loop material 420 or another fastening material may be included in or secured to accessory-fastening portion 424, for instance, via mounting or bonding with glue, resin, hardening agents, sewing, and/or any other bonding means. Hook-and-loop material 420 or the other fastening material may be removably attachable to hook-and-loop material 132 of accessory restraint system 100 (see FIGS. 1A-1F). As such, mounted attachment 422 may be removably attachable to any fastening portion of accessory restraint system 100 (see FIGS. 1A-1F).

Mounted attachment 422 may be permanently or removably secured to base 414 by one or more fasteners 426. For example, fastener 426 may be a rivet, dowel, screw, or any other fastener or fastener-type material. Fastener 426 may secure mounted attachment 422 to base 414 in a fixed or movable manner. For example, mounted attachment 422 may be fixed with respect to base 414 or may be rotatable, with respect to base 414, about fastener 426. In this manner, mounted attachment 422 may provide for removable firearm holster 402 to be ergonomically secured about garment 104 (see FIGS. 1A-1E), regardless of garment type.

Figure 5:
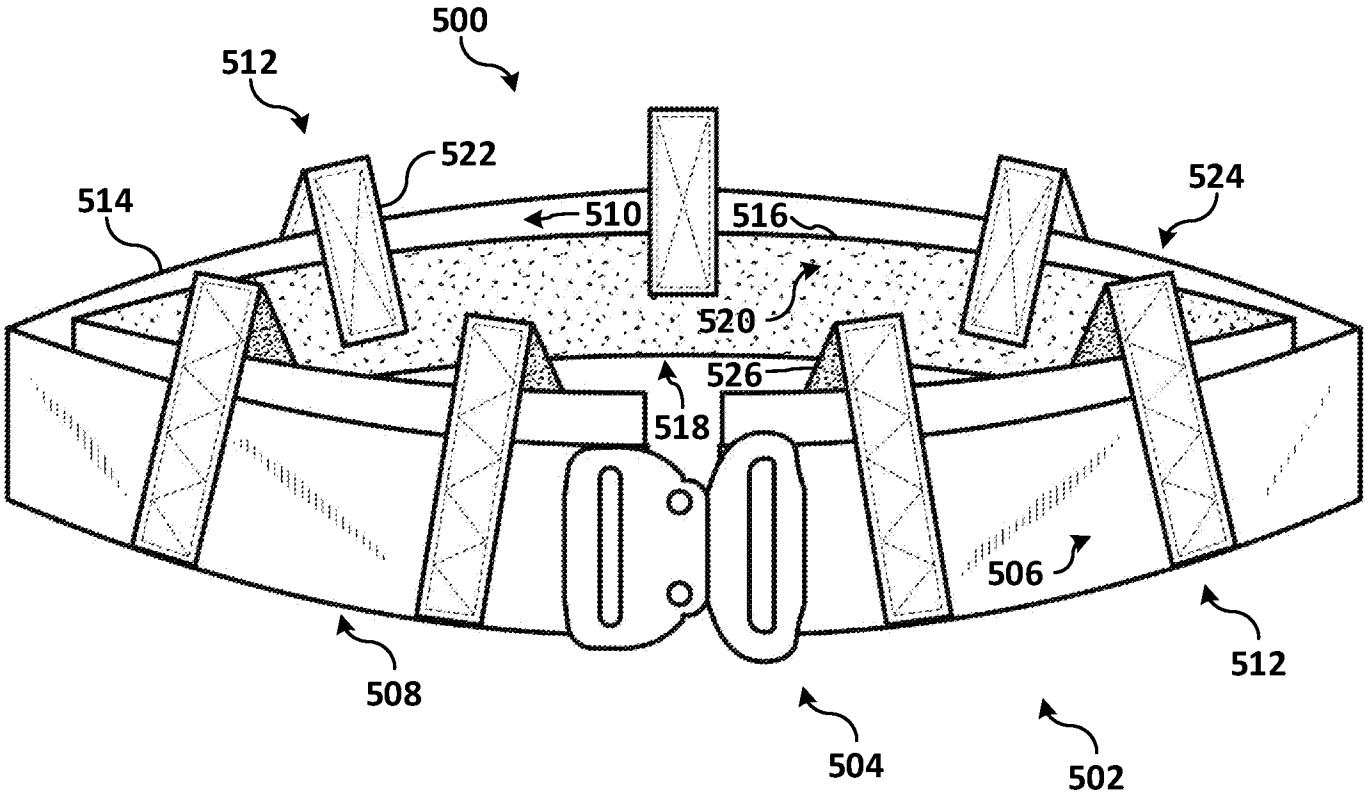
FIG. 5 is a perspective view of an accessory restraint system associated with a garment, as well as an accessory associated with the accessory restraint system, in accordance with one or more aspects of the present disclosure.

Referring now to FIG. 5, and in brief overview, accessory restraint system 500 may have a substantially similar configuration to that of accessory restraint system 100 (see FIGS. 1A-1F) and may be removably attachable to accessory 502. Accessory 502 may include removable utility belt 504, which may be configured in any shape or size suitable for use as a utility, battle, or holster belt. Removable utility belt 504 may be made, in whole or in part, of belt material 506, which may be any material suitable for use as a belt (e.g., nylon webbing, synthetic material, leather, or bonded leather). Removable utility belt 504 may include front surface 508, rear surface 510, and/or one or more tab extensions 512.

As shown in FIG. 5, removable utility belt 504 may be dimensionally compatible with accessory restraint system 500. For example, belt size 514 of removable utility belt 504 may be within an acceptable tolerance of length 516 of accessory restraint system 500. Accordingly, removable utility belt may also be dimensionally compatible with, for example, garment 104 (see FIGS. 1A-1E), which may be securable to accessory restraint system 500 as might similarly be the case with respect to accessory restraint system 100 (see FIGS. 1A-1F).

Accessory restraint system 500 and tab extensions 512 may include, respectively, one or more fastening portions 518 and one or more accessory-fastening portions 524, which may be compatible with one another. For example, fastening portion 518 and accessory-fastening portions 524 may include hook-and-loop material 520 and 526, respectively, which may be removably attachable to one another. Accordingly, accessory 502 may be removably attachable to accessory restraint system 500, which may allow the user to more quickly or efficiently put on (or remove) removable utility belt 504 than would be possible with traditional utility or battle belt configurations that require switching between two or more belts. To that end, accessory restraint system 500 may effectively replace the second belt required with most traditional utility or battle belt configurations.

Tab extensions 512 may, for example, be sewn or otherwise secured to removable utility belt 504 and may further include one or more inner tabs 522, to which accessory-fastening portions 524 may be sewn or otherwise secured. For example, as illustrated by the present embodiment, accessory-fastening portions 524 may include hook-and-loop material 526 sewn to inner tabs 522. Accordingly, tab extensions 512 may facilitate removable attachment of accessory 502 to accessory restraint system 500.

Figure 6B:
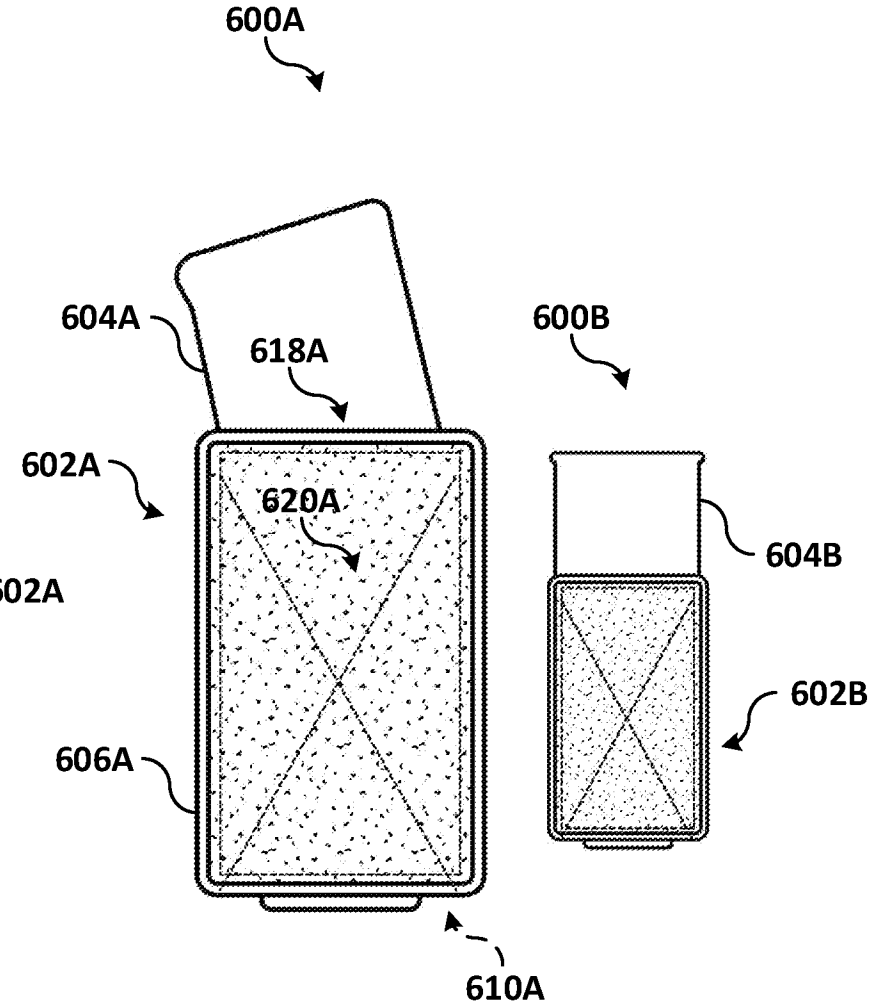
FIGS. 6A and 6B are, respectively, front and rear views of an accessory, attachable to an accessory restraint system, in accordance with one or more aspects of the present disclosure.
Figure 6A:
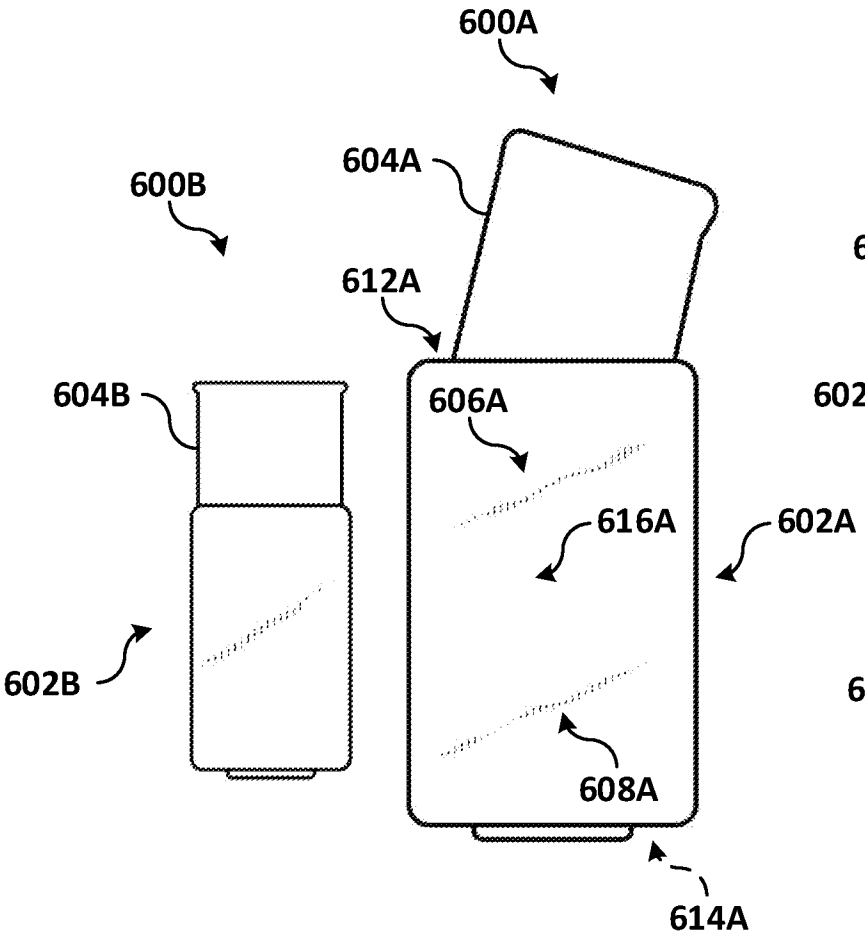
Figure 6C:
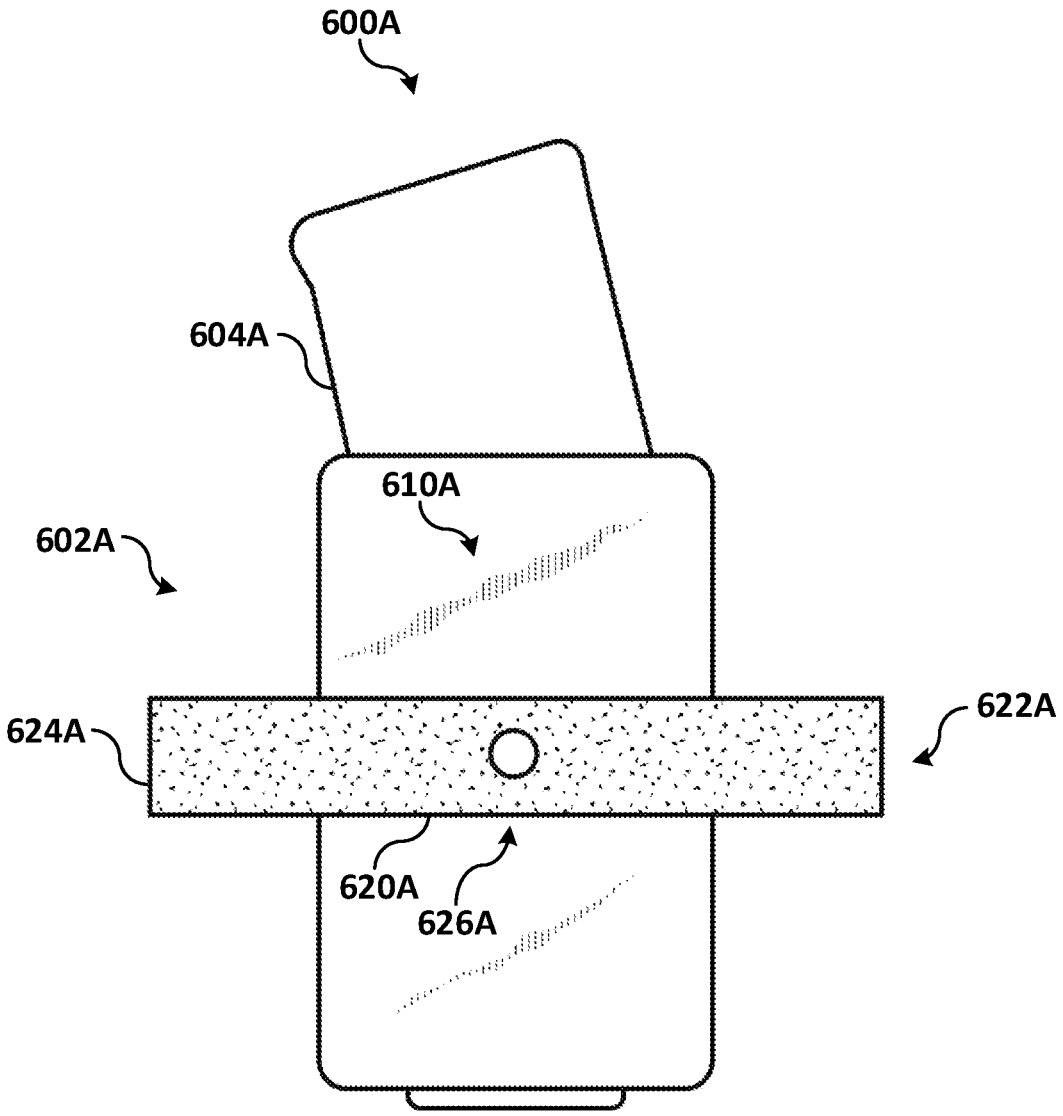
FIG. 6C is a rear view of an accessory, attachable to an accessory restraint system, in accordance with one or more aspects of the present disclosure.

Referring now to FIGS. 6A-6C, and in brief overview, accessory 600A or 600B may include removable magazine pouch 602A or 602B, respectively, which may be configured in any shape or size suitable for use as a pouch for magazine 604A or 604B. Referring, by way of example, to removable magazine pouch 602A, removable magazine pouch 602A may be made, in whole or in part, of magazine pouch material 606A, which may be any material suitable for use as a magazine pouch (e.g., elastic, nylon, woven material, synthetic material, or leather, Boltaron®, Tegris®, Kydex or other thermoplastics, or Tweave-type material). Removable magazine pouch 602A may include front surface 608A, rear surface 610A, and top portion 612A.

As shown in FIG. 6A, removable magazine pouch 602A may be designed to receive magazine 604A about top portion 612A. For example, removable magazine pouch 602A may include base 614A and carrying element 616A. Base 614A and/or carrying element 616A may be made of magazine pouch material 606A, which may be, for instance, elastic to accommodate a range of configurations of magazine 604A. Carrying element 616A may be any feature or component designed to carry magazine 604A, which may also contact base 614A. Front surface 608A may be designed to proximately contact the user during use of accessory 600A, as further described below.

As shown in FIG. 6B, removable magazine pouch 602A may further include accessory-fastening portion 618A, which may be compatible with one or more fastening portions of accessory restraint system 100 (see FIGS. 1A-1F). Accordingly, accessory 600A may be removably attachable to accessory restraint system 100 (see FIGS. 1A-1F), which may allow the user to access magazine 604A while removable magazine pouch 602A is proximate to interior portion 122 of garment 104 (see FIGS. 1A-1F). For example, accessory-fastening portion 618A may include hook-and-loop material 620A or another fastening material, which may be removably attachable to hook-and-loop material 132 (see FIGS. 1A-1F). Accessory-fastening portion 618A may be secured to magazine pouch material 606A on rear surface 610A of removable magazine pouch 602A using any suitable means of attachment. For example, accessory-fastening portion 618A may include hook-and-loop material 620A sewn or bonded to magazine pouch material 606A about base 614A on rear surface 610A of removable magazine pouch 602A. Alternatively, or in addition, accessory-fastening portion 618A may be secured to magazine pouch material 606A using various means similar to attachment means 124 (see FIGS. 1B and 1E).

As shown in FIG. 6C, removable magazine pouch 602A may be used with means for removably attaching accessory 600A to accessory restraint system 100 (see FIGS. 1A-1F) other than accessory-fastening portion 618A secured directly to magazine pouch material 606A on rear surface 610A of removable magazine pouch 602A. For example, accessory 600A may further include mounted attachment 622A. Mounted attachment 622A may have any shape or dimensions. For example, mounted attachment 622A may be a square, rectangular, or round shape having any dimensions. Mounted attachment 622A may be composed of any one or more materials. For example, materials from which mounted attachment 622A is composed may include Kydex, Boltaron®, Tegris®, and/or any other synthetic or natural material.

Mounted attachment 622A may include accessory-fastening portion 624A. Hook-and-loop material 620A or another fastening material may be included in or secured to accessory-fastening portion 624A, for instance, via mounting or bonding with glue, resin, hardening agents, sewing, and/or any other bonding means. Hook-and-loop material 620A or the other fastening material may be removably attachable to hook-and-loop material 132 of accessory restraint system 100 (see FIGS. 1A-1F). As such, mounted attachment 622A may be removably attachable to any fastening portion of accessory restraint system 100 (see FIGS. 1A-1F).

Mounted attachment 622A may be permanently or removably secured to rear surface 610A by one or more fasteners 626A. For example, fastener 626A may be a rivet, dowel, screw, or any other fastener or fastener-type material. Fastener 626A may secure mounted attachment 622A to rear surface 610A in a fixed or movable manner. For example, mounted attachment 622A may be fixed with respect to rear surface 610A or may be rotatable, with respect to rear surface 610A, about fastener 626A. In this manner, mounted attachment 622A may provide for removable magazine pouch 602A to be ergonomically secured about garment 104 (see FIGS. 1A-1E), regardless of garment type.

Figure 7:
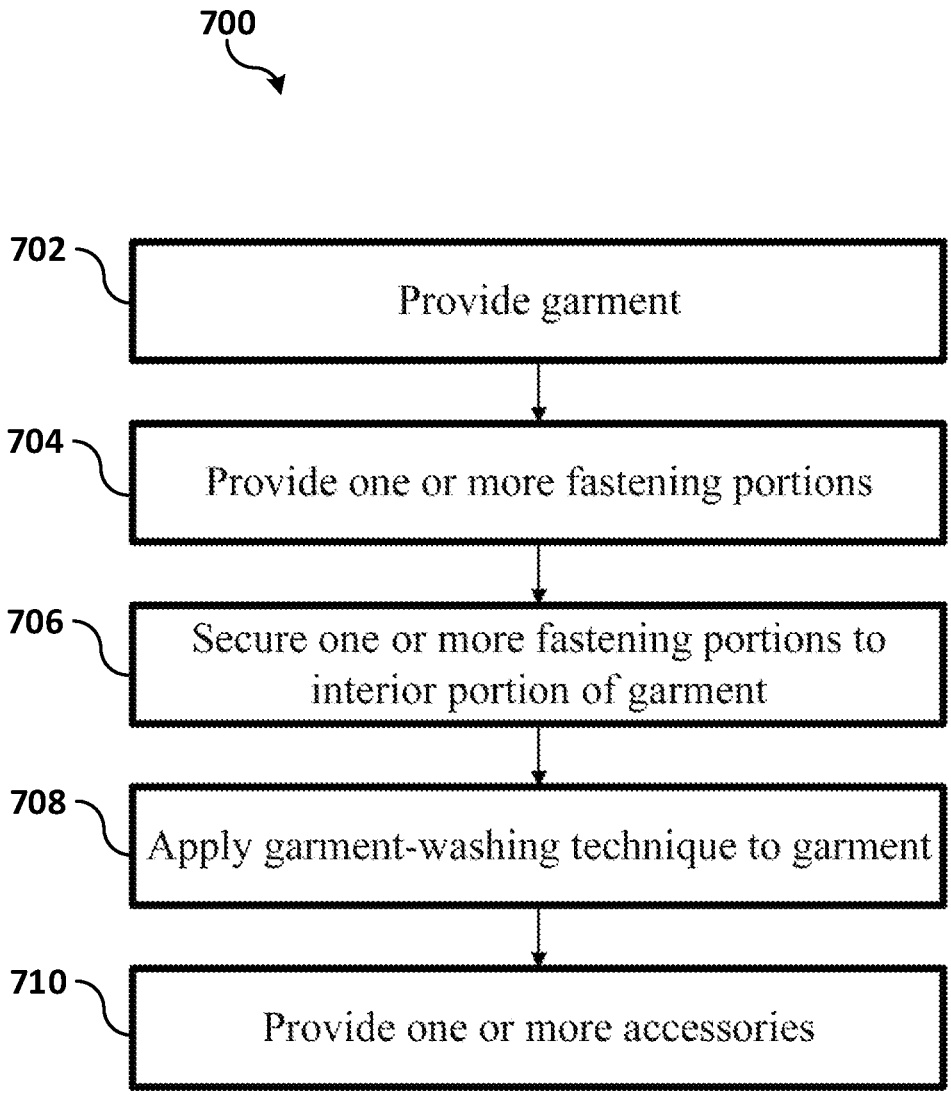
FIG. 7 is a flowchart illustrating example steps for manufacturing an accessory restraint system in accordance with one or more principles of the present disclosure.

Referring now to FIG. 7, and in brief overview, method 700 of manufacturing an accessory restraint system securable to a garment (e.g., accessory restraint system 100 securable to garment 104 in FIGS. 1A-1F) may include steps 702, 704, 706, 708, and/or 710. It will be understood that the various systems, components, features, and characteristics described herein may correspond to other systems, components, features, and characteristics describe throughout the present disclosure or may relate to different systems, components, features or characteristics. It will further be understood that any of the steps described below are merely illustrative, may be optional, and may be completed in any order, depending on the particular embodiment or application of the present invention.

As shown in FIG. 7, at step 702, a garment may be provided. The garment may be a top or bottom garment or any other article suitable for use as a garment by a user (e.g., a human or an animal), including but not limited to any garment described or otherwise envisioned throughout the present disclosure. The garment may have a stretch characteristic based on its material or design.

At step 704, one or more fastening portions may be provided. The fastening portions may include a hook-and-loop material. The hook-and-loop material may also have a stretch characteristic. The stretch characteristics of the hook-and-loop material and the garment may be within a stretch threshold of one another, which may provide for preferable compatibility between the hook-and-loop material and the garment. The fastening portions may include any number of patches. The patches may each have any length described or envisioned herein, including but not limited to a length between approximately two and eight inches (2-8 in.). The patches may each include the hook-and-loop material or other fastening material. The hook-and-loop material may have any height described or envisioned herein, including but not limited to a height between approximately one and five inches (1-5 in.).

At step 706, one or more fastening portions may be secured to an interior portion of the garment. For example, the fastening portions may be secured to the interior portion of the garment by stitching, such as in a box-stitch pattern, a zigzag-stitch pattern, a bar tack or tacking pattern, or a chain-stitch pattern. The stitching pattern used and/or the location of the stitching may be based on the placement of the fastening portions with respect to the garment, the type of garment to which the fastening portions are being secured, and/or the application of a garment-washing technique before or after stitching.

For example, where a single fastening portion is being placed a full 360 degrees about an inner circumference of the garment, the fastening portion may be secured to the garment using either single-needle stitching after a garment-washing technique is applied (as further described with respect to step 708) or double-needle chain-stitching performed via a folder attachment for a sewing machine before a garment-washing technique is applied (as further described with respect to step 708). Single-needle stitching after garment wash may be used, for instance, with garments having one- or two-piece waistbands and may involve stitching the fastening portions about one-eighth inch (⅛ in.) from the edges, top, and bottom of the fastening portions. Double-needle chain-stitching before garment wash may be used, for instance, with garments having two-piece waistbands.

Where a single fastening portion is being placed 180 degrees about a front or rear half of the inner circumference of the garment, or where multiple fastening portions, patches, and/or segments are being placed in an orientation defining one or more spacings about the inner circumference of the garment, the fastening portions may be secured to the garment using a box-stitch, zigzag-stitch pattern, or bar tack or tacking pattern, which may provide additional reinforcement against wear and tear. The fastening portions may be stitched, for instance, approximately one-eighth inch (⅛ in.) from the edges, top, and bottom of the fastening portions. The fastening portions may be secured to the interior portion of the garment such that the one or more spacings are located between the fastening portions and one or more opening or separation locations of the garment.

At step 708, a garment-washing technique may be applied to the garment. The means by which the fastening portions are secured to the interior portion of the garment at step 706 may be based, at least in part, on the garment-washing technique applied to the garment. For example, where the fastening portions are secured by stitching, the stitching may be performed manually, either by a folder attachment for a sewing machine or by a sewing machine with a sewing foot, based at least in part on the garment-washing technique applied to the garment. If the garment-washing technique includes a heavy wash process, for instance, it may be preferable to stitch the fastening portions to the interior portion of the garment by hand after the heavy wash process has been completed. Alternatively, if the garment-washing technique includes a general wash-rinse-tumble cycle, it may be preferable to stitch the fastening portions to the interior portion of the garment using the folder attachment for the sewing machine or the sewing foot of the sewing machine before the laundry cycle has been completed, which may save time and be more efficient.

At step 710, one or more accessories may be provided. The accessories may be removably attachable to the fastening portions. Each accessory may include one or more accessory-fastening portions. The accessory-fastening portions may each include the hook-and-loop material or a fastening material that is removably attachable to the hook-and-loop material. As such, the accessories may be compatible with, and removably attachable to, the fastening portions secured to the garment.

Although specific embodiments of the present disclosure have been described herein, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further still, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

What is claimed is:

1. An accessory restraint system comprising:

a garment comprising an apparel bottom with a waistband, wherein the waistband is integrally formed with the garment;

one or more fastening portions comprising a hook-and-loop material, wherein the one or more fastener portions are secured to an interior portion of the garment at the waistband of the garment, wherein one or more accessories are removably attachable to the one or more fastening portions.

2. The accessory restraint system of claim 1, wherein the one or more fastening portions are configured to be secured to the interior portion of the garment on at least one of a front surface of the interior portion and a rear surface of the interior portion.

3. The accessory restraint system of claim 1, wherein the one or more fastening portions comprise a single length of the hook-and-loop material.

4. The accessory restraint system of claim 1, wherein the one or more fastening portions comprise a plurality of patches, the plurality of patches each comprising the hook-and-loop material.

5. The accessory restraint system of claim 4, wherein:

the hook-and-loop material has a height between approximately one and five inches, and the plurality of patches each have a length between approximately two and eight inches and are configured to be secured to the interior portion of the garment in an orientation defining one or more spacings between the plurality of patches and one or more opening or separation locations of the garment.

6. The accessory restraint system of claim 1, wherein:

the hook-and-loop material has a first stretch characteristic, the garment has a second stretch characteristic, and the first stretch characteristic is within a stretch threshold of the second stretch characteristic.

7. The accessory restraint system of claim 1, wherein the one or more fastening portions are configured to be secured to the interior portion of the garment by stitching in a box-stitch pattern, a zigzag-stitch pattern, or a bar tack or tacking pattern.

8. The accessory restraint system of claim 1, wherein the one or more accessories each comprise one or more accessory-fastening portions, the one or more accessory-fastening portions each comprising the hook-and-loop material or a fastening material removably attachable to the hook-and-loop material.

9. The accessory restraint system of claim 1, wherein:

the interior portion includes a pocket of the garment.

10. The accessory restraint system of claim 1, wherein the one or more accessories comprise at least one of a pouch, a sheath, a holster, a utility belt, and a magazine pouch.

11. The accessory restraint system of claim 1, wherein the one or more fastening portions are configured to be secured to the interior portion of the garment at one or more attachment locations to prevent the one or more accessories from printing or displaying one or more outlines on an exterior portion of the garment while the one or more accessories are attached to the one or more fastening portions at the one or more attachment locations.

12. An accessory for use with an accessory restraint system securable to a bottom garment at a waistband, the accessory comprising:

a main portion; and one or more accessory-fastening portions securable to the main portion and configured to be removably attached to one or more fastening portions of the accessory restraint system, wherein the one or more fastening portions of the accessory restraint system are secured to an interior portion of the bottom garment at the waistband of the bottom garment, wherein the waistband is integrally formed with the garment, wherein the one or more accessory-fastening portions of the accessory and the one or more fastening portions of the accessory restraint system each comprise a hook-and-loop material or a fastening material removably attachable to the hook-and-loop material.

13. The accessory of claim 12, wherein the one or more accessory-fastening portions are permanently securable to the main portion by stitching, gluing, or bonding.

14. The accessory of claim 12, further comprising one or more mounted attachments, the one or more mounted attachments comprising the one or more accessory-fastening portions, wherein the one or more mounted attachments are permanently or removably securable to the main portion by one or more fasteners.

15. The accessory of claim 14, wherein the one or more mounted attachments are rotatable, with respect to the main portion, about the one or more fasteners.

16. The accessory of claim 12, wherein the accessory comprises at least one of a pouch, a sheath, a holster, a utility belt, and a magazine pouch.

* * * * *